US008642953B2

(12) United States Patent
Turteltaub et al.

(10) Patent No.: US 8,642,953 B2
(45) Date of Patent: Feb. 4, 2014

(54) INTERFACE FOR THE RAPID ANALYSIS OF LIQUID SAMPLES BY ACCELERATOR MASS SPECTROMETRY

(75) Inventors: Kenneth Turteltaub, Livermore, CA (US); Ted Ognibene, Oakland, CA (US); Avi Thomas, Mountain House, CA (US); Paul F. Daley, El Sobrante, CA (US); Gary A Salazar Quintero, Livermore, CA (US); Graham Bench, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 13/396,461

(22) Filed: Feb. 14, 2012

(65) Prior Publication Data

US 2012/0235031 A1 Sep. 20, 2012

Related U.S. Application Data

(60) Provisional application No. 61/452,915, filed on Mar. 15, 2011.

(51) Int. Cl.
*H01J 49/04* (2006.01)

(52) U.S. Cl.
USPC ..... 250/288; 250/282

(58) Field of Classification Search
USPC ..... 250/281, 282, 288
See application file for complete search history.

(56) References Cited

U.S. PATENT DOCUMENTS

| | | | | |
|---|---|---|---|---|
| 3,928,519 | A * | 12/1975 | Kashiyama et al. | 264/40.7 |
| 5,426,301 | A | 6/1995 | Turner et al. | |
| 6,462,334 | B1 * | 10/2002 | Little et al. | 250/281 |
| 6,707,035 | B2 | 3/2004 | Hughey et al. | |
| 6,867,415 | B2 | 3/2005 | Hughey et al. | |
| 7,820,966 | B2 | 10/2010 | Bateman et al. | |
| 2001/0051714 | A1 * | 12/2001 | Chen et al. | 536/24.3 |
| 2005/0148095 | A1 * | 7/2005 | Massaro | 436/180 |
| 2008/0265152 | A1 * | 10/2008 | Bateman | 250/283 |
| 2010/0276589 | A1 * | 11/2010 | McKay et al. | 250/288 |
| 2011/0000577 | A1 * | 1/2011 | Bogursky et al. | 140/71 R |

OTHER PUBLICATIONS

Sessions et al., "Moving-Wire Device for Carbon Isotopic Analyses of Nanogram Quantities of Nonvolatile Organic Carbon", Anal. Chem, 2005, 77, 6519-6527.*

Sessions et al, "Moving-Wire Device for Carbon Isotopic Analyses of Nanogram Quantities of Nonvolatile Organic Carbon", Anal. Chem, 2005, 77, 6519-6527.*

(Continued)

*Primary Examiner* — Robert Kim
*Assistant Examiner* — David E Smith
(74) *Attorney, Agent, or Firm* — Eddie E. Scott

(57) ABSTRACT

An interface for the analysis of liquid sample having carbon content by an accelerator mass spectrometer including a wire, defects on the wire, a system for moving the wire, a droplet maker for producing droplets of the liquid sample and placing the droplets of the liquid sample on the wire in the defects, a system that converts the carbon content of the droplets of the liquid sample to carbon dioxide gas in a helium stream, and a gas-accepting ion source connected to the accelerator mass spectrometer that receives the carbon dioxide gas of the sample in a helium stream and introduces the carbon dioxide gas of the sample into the accelerator mass spectrometer.

2 Claims, 16 Drawing Sheets

(56) References Cited

OTHER PUBLICATIONS

Sessions et al, "Moving Wire Device for Carbon-Isotopic Analyses of Nanogram Quantities of Nonvolatile Organic Carbon", Anal. Chem. 2005, 77, 6519-6527.*

Caimi et al., "High-Precision Liquid Chromatography-Combustion Ratio Mass Spectrometry", Anal. Chem. 1993, 65, 3497-3500.*

Thomas, "A nearly 100% efficient moving wire combustion interface for on-line coupling of HPLC," presented at the 2011 ACS Fall National Meeting &Exposition, Aug. 28, 2011.

Thomas, Ultrahigh Efficiency Moving Wire Combustion Interface for Online Coupling of High-Performance Liquid Chromatograph (HPLC), Anal. Chem. 2011, 83, 9413-9417.

* cited by examiner

INTERFACE FOR THE RAPID ANALYSIS OF LIQUID SAMPLES BY ACCELERATOR MASS SPECTROMETRY

CROSS-REFERENCE TO RELATED APPLICATIONS

This application claims benefit under 35 U.S.C. §119(e) of U.S. Provisional Patent Application No. 61/452,915 filed Mar. 15, 2011 entitled "interface for the rapid analysis of liquid samples by accelerator mass spectrometry," the disclosure of which is hereby incorporated by reference in its entirety for all purposes.

STATEMENT AS TO RIGHTS TO INVENTIONS MADE UNDER FEDERALLY SPONSORED RESEARCH AND DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

BACKGROUND

1. Field of Endeavor

The present invention relates to accelerator mass spectrometry (AMS) and more particularly to an interface for the rapid analysis of liquid samples by AMS.

2. State of Technology

Accelerator mass spectrometry (AMS) is the use of a combination of mass spectrometers and an accelerator to measure and analyze samples. L. W. Alvarez and Robert Cornog of the United States first used an accelerator as a mass spectrometer in 1939 when they employed a cyclotron to demonstrate that $^{3}$He was stable; from this observation, they immediately (and correctly) concluded that the other mass-3 isotope tritium was radioactive. In 1977, inspired by this early work, Richard A. Muller at the Lawrence Berkeley Laboratory recognized that modern accelerators could accelerate radioactive particles to an energy where the background interferences could be separated using particle identification techniques. He published the seminal paper in *Science* showing how accelerators (cyclotrons and linear) could be used for detection of tritium, radiocarbon ($^{14}$C), and several other isotopes of scientific interest including $^{10}$Be; he also reported the first successful radioisotope date experimentally obtained using tritium ($^{3}$H). His paper was the direct inspiration for other groups using cyclotrons (G. Raisbeck and F. Yiou, in France) and tandem linear accelerators (D. Nelson, R. Korteling, W. Stott at McMaster). K. Purser and colleagues also published the successful detection of radiocarbon using their tandem at Rochester. Soon afterwards the Berkeley and French teams reported the successful detection of $^{10}$Be, an isotope widely used in geology. Soon the accelerator technique, because it was about a factor of 1000 more sensitive, virtually supplanted the older "decay counting" methods for these and other radioisotopes.

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives failing within the spirit and scope of the invention as defined by the claims.

The present invention in one embodiment provides an interface for the analysis of liquid sample having carbon content by an accelerator mass spectrometer including a wire, defects on the wire, a system for moving the wire, a droplet maker for producing droplets of the liquid sample and placing the droplets of the liquid sample on the wire in the defects, a system that converts the carbon content of the droplets of the liquid sample to carbon dioxide gas in a helium stream, and a gas-accepting ion source connected to the accelerator mass spectrometer that receives the carbon dioxide gas of the sample in a helium stream and introduces the carbon dioxide gas of the sample into the accelerator mass spectrometer.

The present invention in another embodiment provides a method of analysis of a liquid sample having carbon content by an accelerator mass spectrometer including the steps of providing a wire, providing defects in the wire, providing a system for moving the wire, producing droplets of the liquid sample and placing the droplets of the liquid sample on the wire in the defects, converting the carbon content of the droplets of the liquid sample to carbon dioxide gas in a helium stream, and using a gas-accepting ion source to introduce the carbon dioxide gas of the sample into the accelerator mass spectrometer.

The present invention has use in biomedical, environmental and carbon cycle research. The present invention also has use to determine the concentration of $^{14}$C, e.g. by archaeologists for radiocarbon dating.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

FIGS. 10A, 10B, 10C, 10D and 10E correspond to.

DETAILED DESCRIPTION OF SPECIFIC EMBODIMENTS

Figure 1:
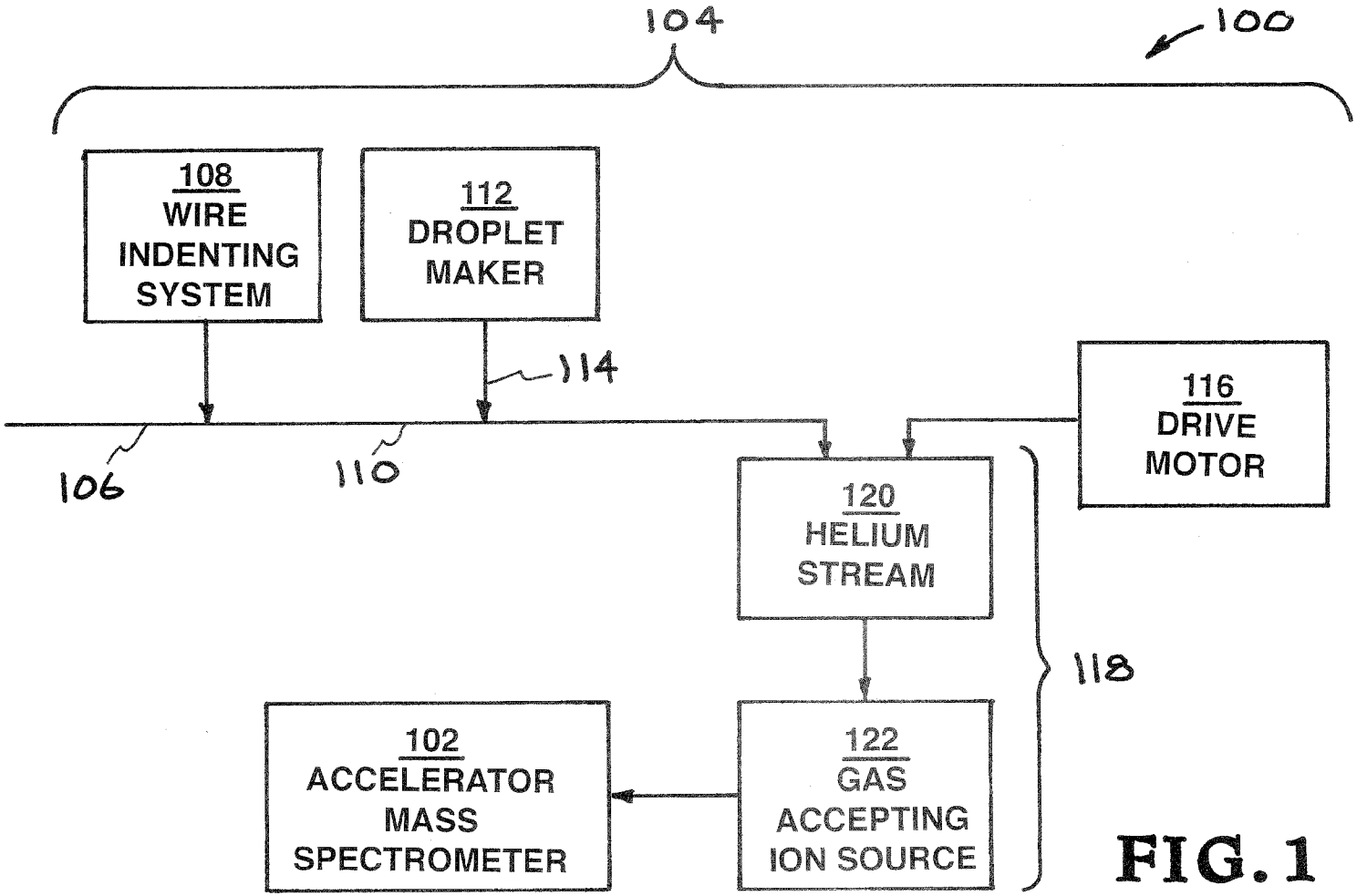
FIG. 1 illustrates an embodiment of a system for analysis of liquid sample having carbon content by an accelerator mass spectrometer.

Referring to the drawings, to the following detailed description, and to incorporated materials, detailed information about the invention is provided including the description of specific embodiments. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

AMS is a type of isotope-ratio mass spectrometer (IRMS). The accuracy and precision of an AMS ratio determination is well documented, since AMS is routinely used in the much more stringent application of isotope chronometry (i.e., $^{14}C$–dating). Isotope ratio MS quantitation requires that all related processes be free of isotope effects, that is, minimal or constant isotopic fractionation. Analytical separation processes fractionate, both isotopically and (by definition) chemically. Isotope fractionation in chemical definition of the sample is negligible for most "bulk" processes, but must be assessed as AMS is mated to micro-bore and other velocity-dependent separation techniques. Applicants define AMS process fractionation as that occurring after a particular point of chemical speciation and homogenization. Historically, this point has been the total oxidation or combustion of a carbon sample to $CO_2$. This process guarantees full equivalence and equilibrium between sample, tracer compound, and any added carrier compounds. Accurate analyses with AMS also depend on careful sample "accounting": homogenization, control of any volatile components, and quantitation of amounts of carrier compounds. All three of these time consuming efforts will be eliminated by more sophisticated sample definition and improved sample spectrometer interface development. Quantitative conversion of the separated analyte to this gas is the heart of our approach.

Current cesium-sputter ion sources used for AMS are relatively efficient (1-10%) but create negative elemental ions in a low-energy environment in which the acquisition of an electron is a velocity dependent function. This type of ion source does fractionate, but the effect is controlled if all samples and standards are introduced into the ion source as a common physical/chemical form. This fractionation problem has been solved for $^{14}C$AMS through quantitative conversion of carbon in a sample to $CO_2$ by total combustion and subsequent reduction of the $CO_2$ to graphite.

In Applicants Center for Accelerator Mass Spectrometry's (CAMS) ion source, graphite samples produce intense negative ion beams (>150 pA of C). Graphite has no "vapor pressure" which makes sample handling easier, and controls contamination in the case of "hot" samples (>10 fmol $^{14}C$/mg C). One of the main features of the Cs-sputter ion source is the low memory effect between samples. Because of its high ionization efficiency and large ion currents, counting times can be minimized, while maintaining high precision and accuracy. Finally, graphite allows for remote sample production with the measurement conducted at a regional spectrometer.

The conversion of carbonaceous samples to graphite has been extremely successful for the vast majority of AMS applications. However, significant human handling is required and the whole process suffers from low sample throughput (–150 samples processed/day), long turnaround times (–2 days minimum), and sample size limitations (>250 ugs carbon are needed). The addition of carrier carbon can also limit sensitivity to –2 amol $^{4}C$/mg C. Another consideration is the total cost of analysis, especially for quantitation of biochemicals separated by High performance Liquid chromatography (HPLC) or other types of liquid chromatography (LC) such as size exclusion or ion exchange. Applicants typically collect 30 second-wide LC fractions and treat each as an individual sample for analysis. These fractions represent a tradeoff between the cost of the analysis (based on the total number of samples) and the chromatographic resolution. At –$150/sample, one 30 minute LC trace costs $9000; which increases if higher resolution is required. In some instances, the number of samples from an LC trace can be reduced by collecting only fractions containing the peaks of interest. However, this is not always a viable option, especially in studies, where entire metabolite profiles are required.

The online conversion of a sample to $CO_2$ gas fed directly into an ion source for trace isotope analysis overcomes this bottleneck. Applicants have developed an online combustion interface can be used for the analysis of discrete small samples. This will improve throughput, reduce costs by decreasing human involvement in sample preparation, as well as by reducing accelerator analysis time, while potentially increasing the sensitivity of $^{14}C$. An integrated liquid sample-AMS system will allow many studies to be addressed more rapidly and with smaller samples. $CO_2$ gas ion sources offer several advantages over solid sample ion sources. They make more efficient use of the sample; hence much smaller sized samples may be analyzed. Less sample handling is required, increasing throughput, while reducing turn-around leading to reduced background contamination. Finally, they are amenable to the measurement of the continuous output of a gas stream, giving higher time resolution for flow separations. In addition, the direct coupling of a gas-accepting source to separatory instrumentation (e.g., HPLC) can, in principle, be achieved using an online combustion interface producing a direct $CO_2$ feed into the ion source.

Despite these advantages, the direct analysis of $^{14}CO_2$ has not gained widespread acceptance in the AMS research community. Mainly because gas sources generally have lower ion output than solid sources leading to a decrease in sample measurement throughput for certain samples. Also, the background level increases with time if high isotope concentrations are introduced without efforts to reduce this contamination of the ion source. Thus, few gas-ion sources find routine use on spectrometers that require the highest precision and accuracy. With the advent of smaller, less expensive spectrometers, some operating on potentials as low as 200 kV, the role of a gas-fed ion source can be revisited to obtain more efficient use of sample material. A Modern ($10^{-12}$ $^{14}C$/C) sample containing 500 pg of carbon, our preferred sample size for solid sample preparation, routinely produces a sample current from our ion source of 100-150 pA and a $^{14}C$ count rate of about 300 Hz. Applicants measure a sample for at least 4 cycles of at least 15,000 counts for 60,000 total $^{14}C$ counts. This is done in 200 seconds with approximately 10% added time for the ion current to come to a stable output and for data acquisition overhead. Thus, a measurement of a 1 Modern sample takes about 4 minutes, during which 30 milliCoulombs of carbon are extracted as negative ions in a process that is on the order of a few percent efficient, requiring 6.2 pmol carbon atoms: 75 pg of carbon, or 15% of the total carbon. The gas-fed source has about twice the efficiency in ionizing the sample to negative carbon ions, but has an output of only 10% that of the solid source. The same 75 pg will require about 80 minutes of measurement to obtain similar statistics of counting. Thus, the gas-ion source is not suitable to high throughput of large samples or high precision measurements. The gas source is valuable, however, for very small samples that pass though the system rapidly, as is found for materials directly combusted coming from an HPLC.

The Radiocarbon Accelerator Unit at the University of Oxford is currently the only AMS group that routinely performs $^{14}C$-AMS analyses using $CO_2$ for accurate and precise carbon isotope chronometry. In the past few years, several AMS research laboratories have acquired or developed gas-accepting ion sources and have begun to develop samples introduction interfaces. The National Ocean Sciences AMS (NOSAMS) Facility at the Woods Hole Oceanographic Institution is developing a gas-accepting ion source that uses a microwave-driven plasma to generate positive ions. A magnesium oven charge-exchange canal is used to convert positive ions to negative ions for injection into the spectrometer. They have developed an interface to directly couple the output of a gas chromatograph to their ion source (McIntyre et al., 2009). For these laboratories, the emphasis has been on the quantification of $^{14}C$ from GC-separated compounds from natural sources to understand carbon cycling in the environment or on carbon dating applications from small samples.

The BEAMS lab, located at the Massachusetts Institute of Technology, uses a modified cesium-sputter ion source to accept gaseous $CO_2$ and $H_2$ (Hughey of al., 1997, 2000). They have also developed LC and GC interfaces for $^{14}C$– and $^{3}H$-AMS quantification of biochemicals. Their interface for the analysis of nonvolatile biochemicals relies on the analysis of discrete samples. Individual fractions from an HPLC are deposited into a well filled with CuO. After the solvent has evaporated, the dried sample is combusted by an infrared laser to produce $CO_2$ which is then transported to the ion source in a helium carrier gas. Only total $^{14}C$ counts are recorded, (i.e., not isotope ratios) essentially limiting the use of this system as a radiocarbon detector. This system can analyze samples containing picogram quantities of carbon without the addition of carrier carbon, assuming that the degree of $^{14}C$-labeling is great enough. However, sensitivity and throughput are low, mainly due to the limitations of their accelerator, which is custom-built from an in-house design.

National Electrostatics Corporation (Middleton, Wis.), developed and markets a gas-accepting ion source for use with AMS spectrometers. It is a modification of their cesium-sputter ion source for solid samples, and has been designed to accept both solid and gaseous samples. Applicants performed ion-optics calculations and designed a beam line to transport both carbon and hydrogen isotopes, as well as matching the phase space of the ion beam to the acceptance of the accelerator. Based on these calculations, Applicants purchased such a gas-accepting ion source and associated beam line components.

This ion source, as purchased from National Electrostatics Corporation in 2002, required significant modifications to improve its overall ionization efficiency and serviceability. Subsequently, Applicants redesigned the interior of the ion source, primarily in the cesium feed and cesium ionization region. Applicants also modified the ion extraction region and increased the vacuum pumping capabilities. These redesigns were based on the successes that Applicants have had in improving the output of the LLNL ion sources, as well as on the work of others in improving the output of the NEC-designed ion sources. Applicants assembled the ion source and its injection beamline onto the 1-MV AMS system through an existing port of a 45° electrostatic analyzer (ESA). The field plates on the ESA can be rotated to transmit ions from either this ion source or from our existing ion source. Typical $^{12}C^{-}$ ion currents are approximately 150 icoamps and overall ion transmission through the system is approximately 30% as measured with solid graphitic samples.

Referring now to the drawings and in particular to FIG. 1, an embodiment of a system for analysis of liquid sample having carbon content by an accelerator mass spectrometer is illustrated. The system is designated generally by the reference numeral 100. The system 100 provides the deposit of liquid samples on an indented moving wire. The moving wire is passed through a system to convert the carbon content of the samples to carbon dioxide gas in a helium stream. The gas is then directed to a high efficiency gas-accepting ion source for AMS analysis.

The system 100 includes an AMS unit 102 and a moving wire interface 104. The moving wire interface 104 includes the following components: wire 106, a wire indentor 108, indentations in the wire 110, a droplet maker 112, sample droplets 114, a drive motor 116 that moves the wire 106, a system 118 that converts the carbon content of the droplets 114 of the liquid sample to carbon dioxide gas in a helium stream 120, and a gas-accepting ion source 122 connected to the accelerator mass spectrometer 102 that receives said carbon dioxide gas of the sample in a helium stream 120 and introduces the carbon dioxide gas of the sample into the accelerator mass spectrometer 120.

The moving wire interface 104 requires that the droplets 114 be placed on the wire 106 to stay at a fixed position such that they move with it. If a droplet 114 is allowed to slide along the wire 106, it will collide with other droplets. At best this decreases resolution and at worst the combined droplets fall off the wire altogether. For fluids that bind weakly to the wire, such as methanol on nickel, this behavior results in a complete failure of the system if preventative steps are not taken. By introducing defects or indentations 110 to the wire at regular intervals this behavior can be prevented.

Referring now to FIGS. 2A through 2E, the defects, i.e. indentations 110, in the wire 106 are shown in greater detail. The static force on either side of a droplet 114 is proportional to the surface area per unit of length where the edge of the droplet makes contact with the wire 106. For a wire that is uniform along its length, the force on either side of a droplet is equal and opposite. In such a case ignoring friction, which may be very small as with methanol on nickel, there is no net force holding the droplet in place and it may slide freely along the length of the wire. If there is a defect on the wire, such that there is a change in surface area per a unit of length compared to a uniform section of wire, where the edge of one side of a droplet makes contact then there will be a net force on the droplet along the length of the wire In this way, the defects or indentations 110 are used to hold a droplet 114 in a fixed position along the wire 106.

The size of the defect should be small compared to the length of the droplet and the spacing of the defects should be more then the width of a droplet so that only one side of a droplet is in contact with a defect at any given time maximizing the trapping potential. The number of defects along the wire should be equal to or greater than twice the number of droplets. This will ensure that there is always a defect between two droplets. The depth of the defect must not be so great as to make the wire too weak nor may it bulge the wire so much that it will not fit through any aperture required for the device's operation. The defects are suitable for capturing droplets of 0.5-4 micoliter.

Figure 2A:
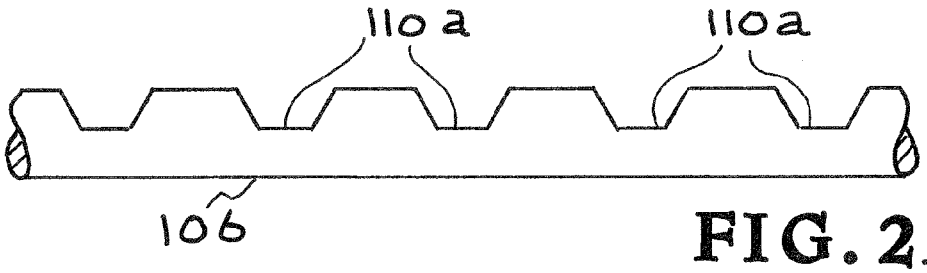
FIGS. 2A through 2D show the indentations in the wire in greater detail.
Figure 2B:
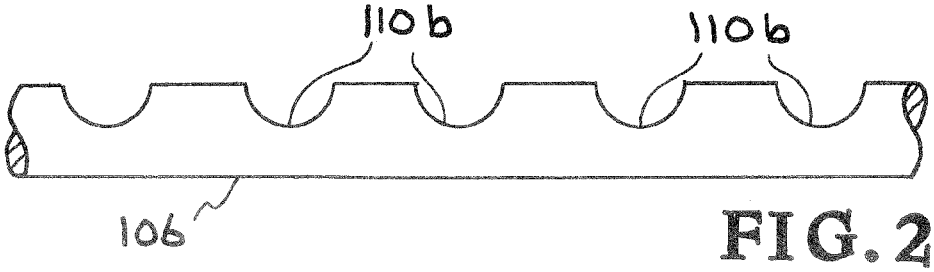
Figure 2C:
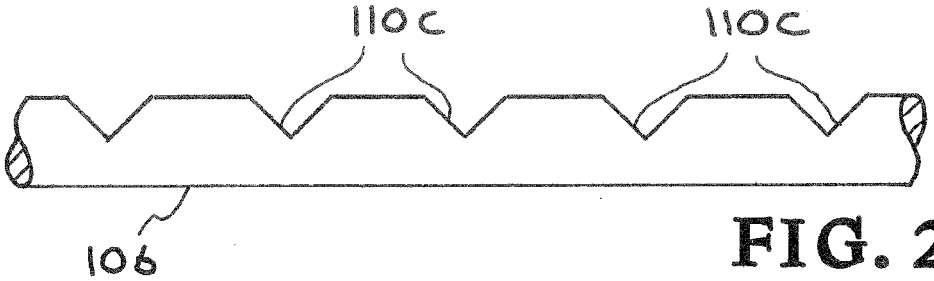
Figure 2D:
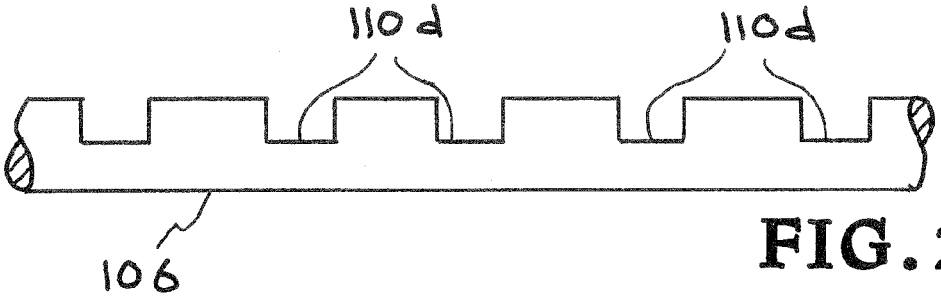

Referring to FIG. 2A the defects, i.e. indentations 110*a*, are "U" shaped indentations with the bottom of the "U" being flat. Referring to FIG. 2B the indentations 110*b* are hemispherical shaped. Referring to FIG. 2C the indentations 110*c* are "V" shaped. Referring to FIG. 2D the indentations 110*d* are rectangular. Referring to FIG. 2E the or indentations 110 are shown holding a droplet 114 in a fixed position along the wire 106.

Figure 3A:
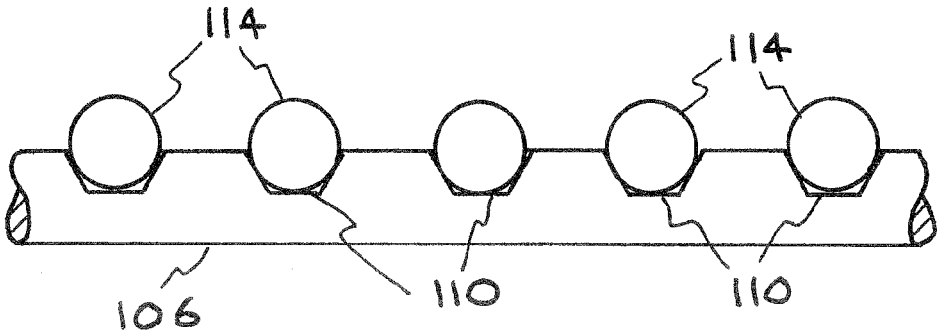
FIG 3A is an example of droplets on an indented wire.
Figure 3B:
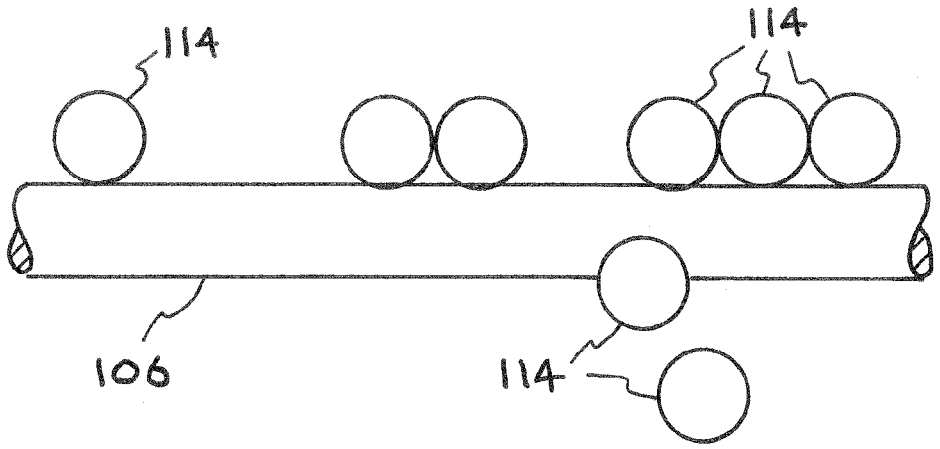
FIG. 3B is an example of droplets on a smooth wire.

Referring now to FIG. 3, an example of droplets 300 on a smooth wire 302 is shown. The wire 302 does not have the defects or indentations that are in the systems shown in FIGS. 1 and 2A through 2E. If a droplet 300 is allowed to slide along the wire 302, it will collide with other droplets. This is illustrated in FIG. 3 where the droplets 300 have clumped together at various locations. It is important that the droplets be placed on the wire to stay at a fixed position such that they move with it.

Referring again to FIG. 1, the wire indentor 108 produces defects or indentations 110 in the wire 106. The defects, defects, or indentations 110 may be achieved through striking the wire with a wedge driven by a solenoid as depicted in FIG. 1. This device uses a solenoid to drive the wedge downward. After striking the wire, the solenoid is reset by a spring. The depth of the defect is controlled by the spacing between the anvil and a block that both guides the wedge and stops it at a set point. Power to the solenoid is controlled through a solid-state relay that in turn is controlled by a computer such that the length of time between impacts and the length of time for which voltage is applied to the solenoid may be varied. The length of time for which voltage is applied to the solenoid must be set so that the solenoid retracts immediately after impact such that it does not grab the wire preventing it from moving smoothly. The length of time between impacts is determined by the rate of droplet formation such that there are one or more defects per a droplet. The defects, defects, or indentations 110 may be achieved through other system including but not limited to a wheel with sharp cutting elements that produce the defects, defects, or indentations 110. The defects, defects, or indentations 110 can also be achieved by adding spaced material on the wire 106. The spaced material can be paint droplets or solder droplets or droplets of other materials.

The system 100 for analysis of liquid sample having carbon content by an accelerator mass spectrometer has been illustrated and described in which the time required for analysis of carbon containing samples by AMS is drastically reduced from days to minutes. Just as importantly the system 100 is also applicable to handling continuous flows of liquid enabling on-line real-time liquid chromatography AMS analysis. This method involves depositing liquid samples on an indented moving wire, and passing the moving wire through a combustion oven to convert samples to carbon dioxide gas in a helium stream. The gas is then directed via a capillary to a gas-accepting ion source for AMS analysis. The development of this system 100 serves to radically decrease sample turnaround time and sample preparation and analysis costs. The system 100 reduces the time required for analysis of carbon containing samples by AMS from days to minutes. The system 100 is also applicable to handling continuous flows of liquid enabling on-line liquid chromatography AMS analysis.

Figure 4:
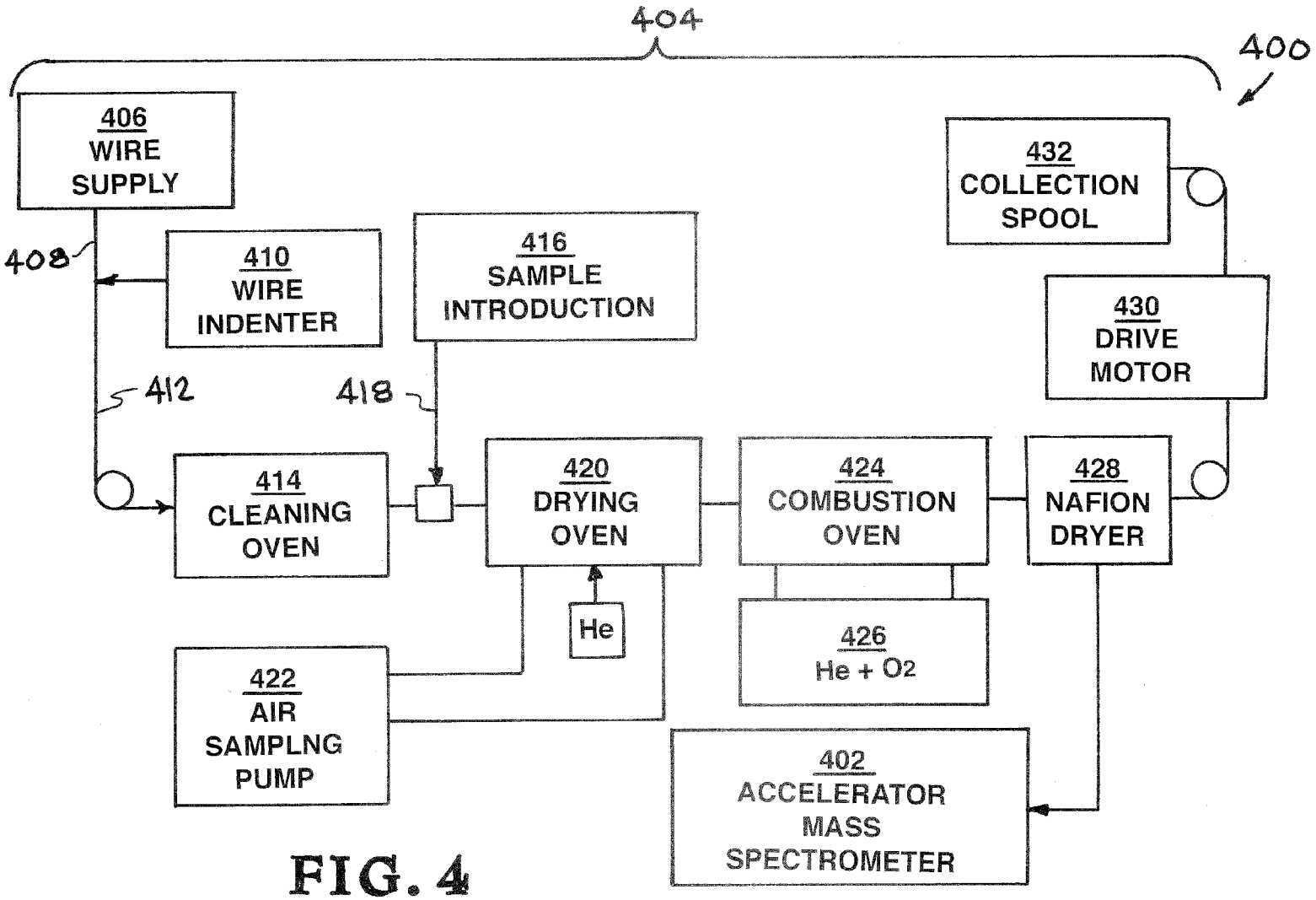
FIG. 4 illustrates another embodiment of a system for the online $^{14}$C and $^{12}$C analysis of materials dissolved or suspended in liquids.

Referring now to FIG. 4, another embodiment of a system for the online and $^{12}C$ analysis of materials dissolved or suspended in liquids is illustrated. The system is designated generally by the reference numeral 400. The system 400 provides the deposit of liquid samples on an indented moving wire. The moving wire is passed through a combustion oven to convert the carbon content of the samples to carbon dioxide gas in a helium stream. The gas is then directed via a capillary to a high efficiency gas-accepting ion source for AMS analysis.

The system 400 includes an AMS unit 402 and a moving wire interface 404. The moving wire interface 404 includes the following components: a supply spool 406, wire 408, a wire indentor 410, indentations in the wire 412, a cleaning oven 414, a system for sample introduction 416, sample droplets 418, a drying oven 420, an air sampling pump 422, a combustion oven 424, He and $O_2$ 426, nafion dryer 428, a drive motor 430, and a collection spool 432. The system 400 reduces the time required for analysis of carbon containing samples by AMS from days to minutes. The system 400 is also applicable to handling continuous flows of liquid enabling on-line liquid chromatography AMS analysis.

The components of the system 400 having been described, the operation of the system 400 will now be considered. One microliter-sized drops 418 of aqueous sucrose solution and sample are deposited onto the moving wire 408 just after the cleaning oven 414.

Applicants have demonstrated that the moving wire interface can convert small carbonaceous liquid samples to carbon dioxide gas and that the ion source is capable of ionizing discrete pulses of $CO_2$ gas. However, the two technologies must be coupled together. Since the optimal helium gas flow rate of the moving wire interface is much larger than the optimal gas flow rate of the ion source, Applicants have found they must limit the amount of helium gas that flows to the ion source while, at the same time, maximize sensitivity by directing as much of the combusted sample to the ion source.

Combustion Oven Plumbing

The first solution deals with the selective removal of helium gas. Applicants have developed a scheme that forces all of the carbon dioxide from the combusted sample to the ion source. The helium carrier and oxygen gas mixture is split prior to entering the combustion oven. Applicants place small diameter tubing on both the upstream and downstream sides of the entrance tee and exit tee, respectively. The helium gas flow is set and controlled such that Applicants have a positive pressure in the combustion oven and excess carrier gas flows out the tees to the atmosphere, thus preventing the inflow of atmospheric gases into the system. Any gas that enters or is generated in the combustion oven can only flow out the 180 urn diameter capillary to the ion source. The diameter of this capillary is set based on the maximum amount of gas that can flow to the ion source before its performance begins to degrade. As Applicants improve vacuum pumping in the ion source, Applicants may be able to increase the diameter of this capillary which will increase the amount of gas that may flow to the ion source which will decrease the sweep time of the combustion oven and could shorten the amount of observed tailing.

Wire Indenter Description

The moving wire interface requires droplets placed on the wire to stay at a fixed position such that they move with it. If a droplet is allowed to slide along the wire, it will collide with other droplets. At best this decreases resolution and at worst the combined droplets fall off the wire altogether. For fluids that bind weakly to the wire, such as methanol on nickel, this behavior results in a complete failure of the system if preventative steps are not taken. By introducing defects to the wire at regular intervals this behavior may be prevented. Applicants claim that introduction of defects on the wire enables us to practically utilize low molecular weight organic solvents and other fluids that bind weakly to the wire in the moving wire interface.

The static force on either side of a droplet is proportional to the surface area per unit of length where the edge of the droplet makes contact with the wire. For a wire that is uniform along its length, the force on either side of a droplet is equal and opposite. In such a case ignoring friction, which may be very small as with methanol on nickel, there is no net force holding the droplet in place and it may slide freely along the length of the wire. If there is a defect on the wire, such that there is a change in surface area per a unit of length compared to a uniform section of wire, where the edge of one side of a droplet makes contact then there will be a net force on the droplet along the length of the wire. In this way, defects may be used to hold at a droplet in a fixed position along the wire.

The size of the defect should be small compared to the length of the droplet and the spacing of the defects should be more then the width of a droplet so that only one side of a droplet is in contact with a defect at any given time maximizing the trapping potential. The number of defects along the wire should be equal to or greater than twice the number of droplets. This will ensure that there is always a defect between two droplets. The depth of the defect must not be so great as to make the wire too weak nor may it bulge the wire so much that it will not fit through any aperture required for the device's operation. The defect is suitable for capturing droplets of 0.5-4 micoliters.

Defects may be achieved through striking the wire with a wedge driven by a solenoid. This device uses a solenoid to drive the wedge downward. After striking the wire, the solenoid is reset by a spring. The depth of the defect is controlled by the spacing between the anvil and a block that both guides the wedge and stops it at a set point.

Power to the solenoid is controlled through a solid-state relay that in turn is controlled by a computer such that the length of time between impacts and the length of time for which voltage is applied to the solenoid may be varied. The length of time for which voltage is applied to the solenoid must be set so that the solenoid retracts immediately after impact such that it does not grab the wire preventing it from moving smoothly. The length of time between impacts is determined by the rate of droplet formation such that there are one or more defects per a droplet.

Analysis by AMS requires that the samples be converted into a form that retains the isotopic ratio of the sample and provides chemical and physical equivalence for all measured atoms. Typical ion sources for routine quantitation of $^{14}C$ require samples to be thermally and electrically conductive solids. Presently, all samples for $^{14}C$-AMS analysis are first combusted to $CO_2$, followed by a chemical reduction to graphite. These methods have been successful for the vast majority of samples measured via AMS. However, a minimum sample size of 0.5 milligram carbon is required for routine preparation. Subsequently, a well-defined amount of carrier carbon, with a low $^{14}C/C$ isotope ratio, is often added to very small samples. This requires quantifiable isotope dilution to maintain precision. Also, significant handling is required for each sample and the whole process suffers from low sample throughput (~150 samples processed/day) and long turnaround times (~2 days minimum). The addition of carrier carbon also limits our sensitivity to ~1 amol $^{14}C$. Another important consideration is the total cost of analysis. For high performance liquid chromatography applications (HPLC) Applicants typically collect 30-second-wide LC fractions and treat each as an individual sample for analysis. At ~$150/sample, one 30 minute LC trace costs $9000; which increases if higher resolution (i.e., more fractions) is required.

Figure 5:
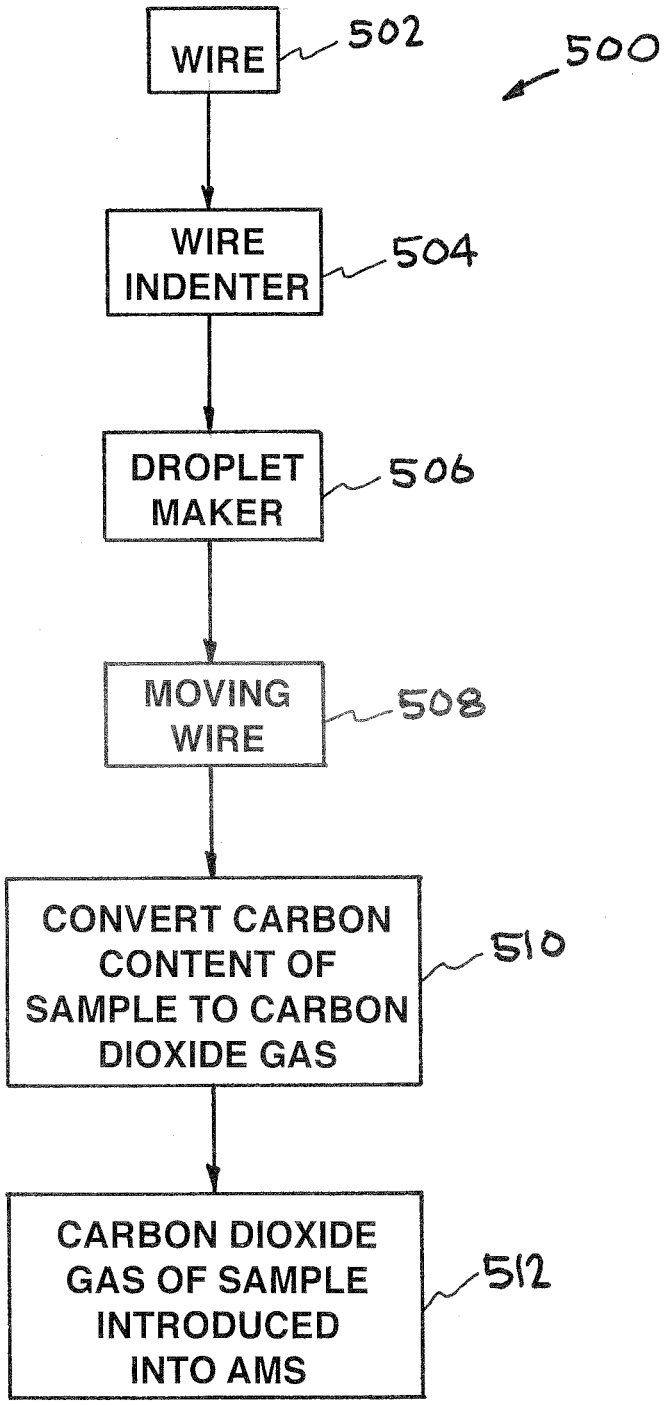
FIG. 5 is a flow chart illustrating another embodiment of a system for analysis of liquid sample having carbon content by an accelerator mass spectrometer.

Referring now to FIG. 5, another embodiment of a system for analysis of liquid sample having carbon content by an accelerator mass spectrometer is illustrated. The system is designated generally by the reference numeral 500. FIG. 5 is a flow chart illustrating the system 500.

The system 500 provides a method of analysis of a liquid sample having carbon content by an accelerator mass spectrometer. The system 500 includes the following steps. In step 502 a wire is provided. In step 504 spaced defects are provided on the wire. In step 506 droplets of the liquid sample are placed on the wire in the defects in the wire. In step 508 the wire is moved from where the droplets of the liquid sample are placed on the wire (in the defects in the wire) to the next processing step. In step 510 the carbon content of the droplets of the liquid sample are converted to carbon dioxide gas of the sample in a helium stream. In step 512 the carbon dioxide gas of the sample in a helium stream is introduced into the accelerator mass spectrometer for analysis.

The system 500 provides the deposit of liquid samples on an indented moving wire. The moving wire is passed through a system to convert the carbon content of the samples to carbon dioxide gas in a helium stream. The gas is then directed to a high efficiency gas-accepting ion source for AMS analysis.

Additional details of the invention are described in the article "Ultrahigh Efficiency Moving Wire Combustion Interface for Online Coupling of High-Performance Liquid Chromatography (HPLC)" by Avi T. Thomas, Ted Ognibene, Paul Daley, Ken Turteltaub, Harry Radousky, and Graham Bench in the journal *Anal. Chem.,* 2011, 83 (24), pp 9413-9417, published Oct. 17, 2011. The disclosure of the article "Ultrahigh Efficiency Moving Wire Combustion Interface for Online Coupling of High-Performance Liquid Chromatography (HPLC)" byAvi T. Thomas, Ted Ognibene, Paul Daley, Ken Turteltaub, Harry Radousky, and Graham Bench in the journal *Anal. Chem.,* 2011, 83 (24), pp 9413-9417, published Oct. 17, 2011 is incorporated in this application in its entirety for all purposes.

Additional details of the invention are described in the Poster published Aug. 28, 2011 by Avi T. Thomas, Ted Ognibene, Paul Daley, Ken Turteltaub, Harry Radousky, and Graham Bench titled "A nearly 100% efficient moving wire combustion interface for on-line coupling of HPLC." Poster published Aug. 28, 2011 by Avi T. Thomas, Ted Ognibene, Paul Daley, Ken Turteltaub, Harry Radousky, and Graham Bench titled "A nearly 100% efficient moving wire combustion interface for on-line coupling of HPLC is incorporated in this application in its entirety for all purposes.

Applicants Ted Ognibene and Gary A. Salazar Quintero have prepared two manuscripts describing the invention and the manuscripts are being or will be submitted to technical journals for publication. The manuscripts have not been published and are included below and are incorporated in this patent application.

"Installation of hybrid ion source on the 1-MV LLNL BioAMS spectrometer" by T. J. Ognibene and G. A. Salazar

[Ognibene et al Manuscript]

Abstract

A second ion source was recently installed onto the LLNL 1-MV AMS spectrometer, which is dedicated to the quantification of $^{14}C$ and $^{3}H$ within biochemical samples. This source is unique among the other LLNL cesium sputter ion sources in that it can ionize both gaseous and solid samples. Also, the injection beam line has been designed to directly measure $^{14}C/^{12}C$ isotope ratios without the need for electrostatic bouncing. Preliminary tests show that this source can ionize transient $CO_2$ gas pulses containing less than 1 ug carbon with approximately 1.5% efficiency. We demonstrate that the measured $^{14}C/^{12}C$ isotope ratio is largely unaffected by small drifts in the argon stripper gas density. We also determine that a tandem accelerating voltage of 670 kV enables the highest $^{14}C$ transmission through the system. Finally, we describe a series of performance tests using solid graphite targets spanning nearly 3 orders in magnitude dynamic range and compare the results to our other ion source.

Introduction

The 1-MV spectrometer at the Center for Accelerator Mass Spectrometry, located at Lawrence Livermore National Laboratory, is dedicated to the quantification of $^{14}C$[1] and, recently, $^{3}H$[2] within biochemical samples. Over 50,000 samples have been analyzed since operations began in May, 2001. High measurement throughput is enabled by the use of the LLNL high-output Cs-sputter solid sample ion source[3].

The use of solid targets necessitates the off-line conversion of biochemical samples to graphite[4] or $TiH_2$[5]. Ion sources that are compatible with the direct input of biochemical separatory instrumentation, such as liquid chromatography, gas chromatography, capillary electrophoresis or other instruments would allow for real-time, automated sample preparation, potentially leading to increased resolution, improved sensitivity through reduced sample handling and the ability to do molecule-specific tracing of very small samples, but with a cost in precision. One such approach would involve the direct introduction of carbon, as $CO_2$, into the ion source. As the LLNL-designed ion source will only accept solid samples, a gas-accepting ion source was installed. This source is a heavily-modified version of the NEC MCGSNICS ion source and is designed to accept both solid and gaseous samples [6].

The injection beam line of this ion source has been designed to allow for the simultaneous measurement of $^{14}C^{+}$ and $^{12}C^{-}$ ions without the need for electrostatic or magnetic isotope switching. In this case, the $^{12}C^{-}$ ions are measured in an off-axis Faraday cup after a magnet located immediately after the ion source. High accuracy and precision require that the transmission of the $^{14}C$ ions through the entire beam line remain constant. In our system, the largest source of transmission variations is from changes in the stripper gas density, which can drift 5-8% during the course of a day's operation. We measured the extent of this effect, as well as changes in the tandem accelerating voltage on $^{14}C$ ion transmission.

In order to have confidence in the results obtained using this new ion source, a series of performance tests were conducted using solid graphitic targets with $^{14}C/C$ isotope ratios spanning 3 orders in dynamic range, which encompasses the majority of bioAMS samples. The use of solid graphitic targets allowed for the direct comparison of the performance of this source to that of the other ion source which can only accept solid samples.

Description

Figure 6:
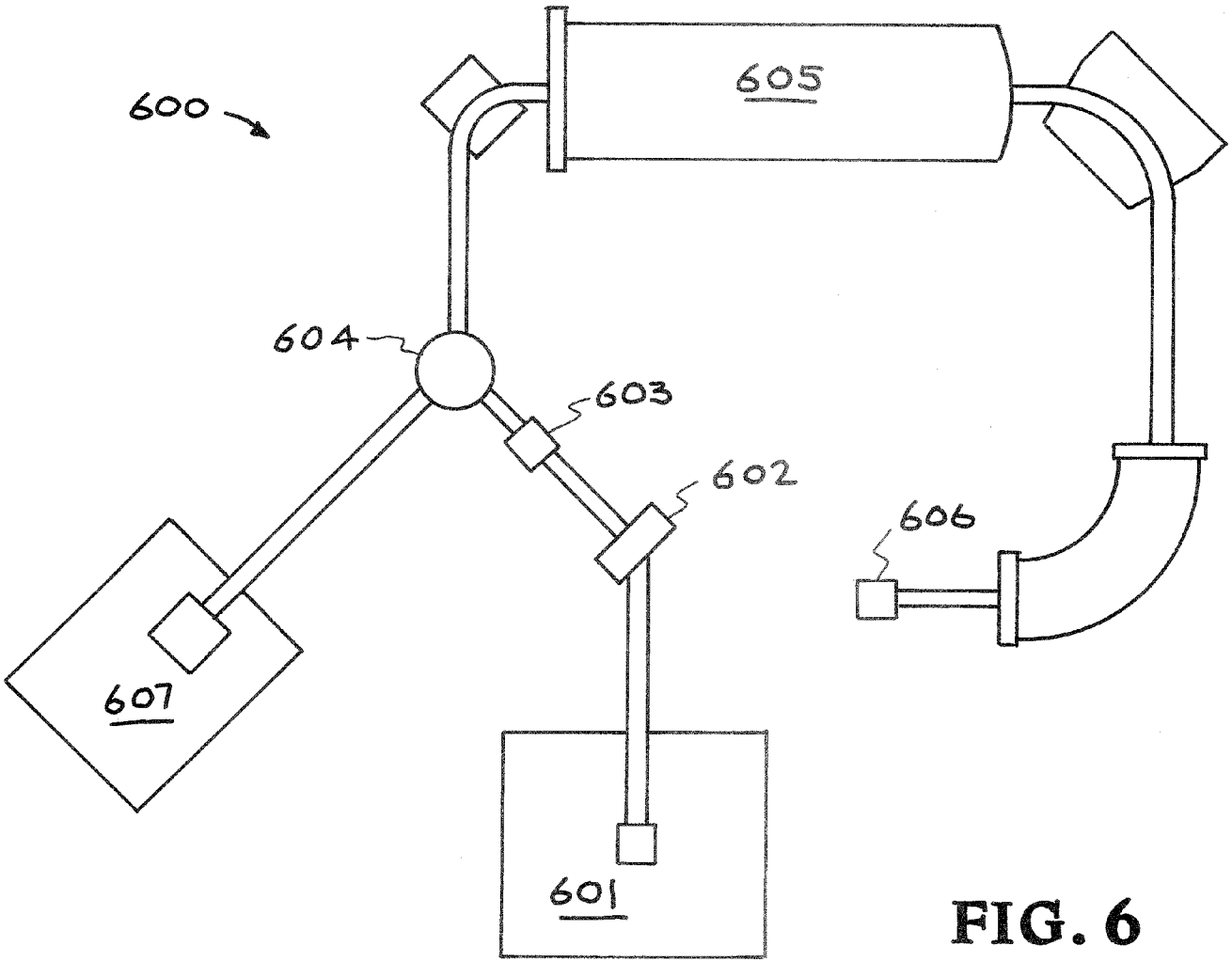
FIG. 6 is FIG. 1 of the Ognibene et al Manuscript showing a schematic layout of the 1-MV AMS system.

FIG. 6 (FIG. 1 of Manuscript) is a schematic layout of the 1-MV AMS system. The 1-MV AMS system is designated generally by the reference numeral 600. The main elements of the system 600 are listed as follows: 601 (Numeral 1 of the Manuscript) hybrid source, 602 (Numeral 2 of the Manuscript) 45° first injector magnet, 603 (Numeral 3 of the Manuscript) $^{12}C^{-}$ Faraday cup, 604 (Numeral 4 of the Manuscript) 45° electrostatic analyzer with rotatable field plates, 605 (Numeral 5 of the Manuscript) 1 MV tandem accelerator, 606 (Numeral 6 of the Manuscript) $^{14}C^{+}$ and $^{3}H^{+}$ detector, and 607 (Numeral 7 of the Manuscript) LLNL solid sample ion source. The new ion source and its associated injection beam line is attached through an existing port of a 45° electrostatic analyzer which can rotate to enable the operation of either ion source. The new injection beam line has been designed to allow for the direct quantification of either $^{14}C/^{12}C$ or $^{3}H/^{1}H$ isotopic ratios [7; 8; 9; 10]. This configuration increases our $^{3}H$-AMS measurement throughput as it eliminates slow magnetic field switching of the injector magnet that is required when using our other source.

As purchased from National Electrostatics Corporation (Middleton, Wis.), the MCGSNICS ion source required significant modifications to improve its output and to provide easier access for maintenance. Many of these modifications were based on the work of Southon et al. [8; 9; 10]. Additionally, for ease of servicing and replacement, we wanted to use the same spherical ionizer and cesium delivery shroud design that is used on the other LLNL-designed ion sources. This ionizer replaced the NEC-supplied conical ionizer. Other modifications included the installation of an immersion lens to replace the cesium focus lens, a large aperture extractor, and a large inner diameter insulator to replace NEC components. We also opened up the interior to provide for better vacuum pumping. Table 1 outlines typical operating parameters.

TABLE I

| Source Operating Parameters | | Source Performance | |
|---|---|---|---|
| Cathode Voltage | 9 kV | Operating Pressure | $6 \times 10^{-7}$ Torr |
| Extractor Voltage | 12 kV | Ion Energy | 49 keV |
| Bias Voltage | 40 kV | Ion Current | 125 uA $^{12}C^{-}$ (graphite) |
| Cesium Temperature | 170° C. | $^{14}C/C$ Background | $\sim 10^{-14}$ (gas) $2 \times 10^{-15}$ (graphite) |
| Ionizer Power | 135 W | | |

Preliminary Gas Sample Performance

Key to the performance of this source is its gas ionization capabilities. In particular, we are interested in the measurement of a transient $CO_2$ pulse generated by an online combustion interface which is directly coupled to biochemical separatory instrumentation, such as high performance liquid chromatography (HPLC). Rapid response with minimal tailing coupled with a high ionization efficiency will ensure that the peak resolution obtained from the HPLC is maintained. To that end, we designed a gas target that fits within the constraints of the NEC sample changer and directs the flow of the $CO_2$ through the target and maximizes its contact with the incoming cesium ion sputter beam [11].

Figure 7:
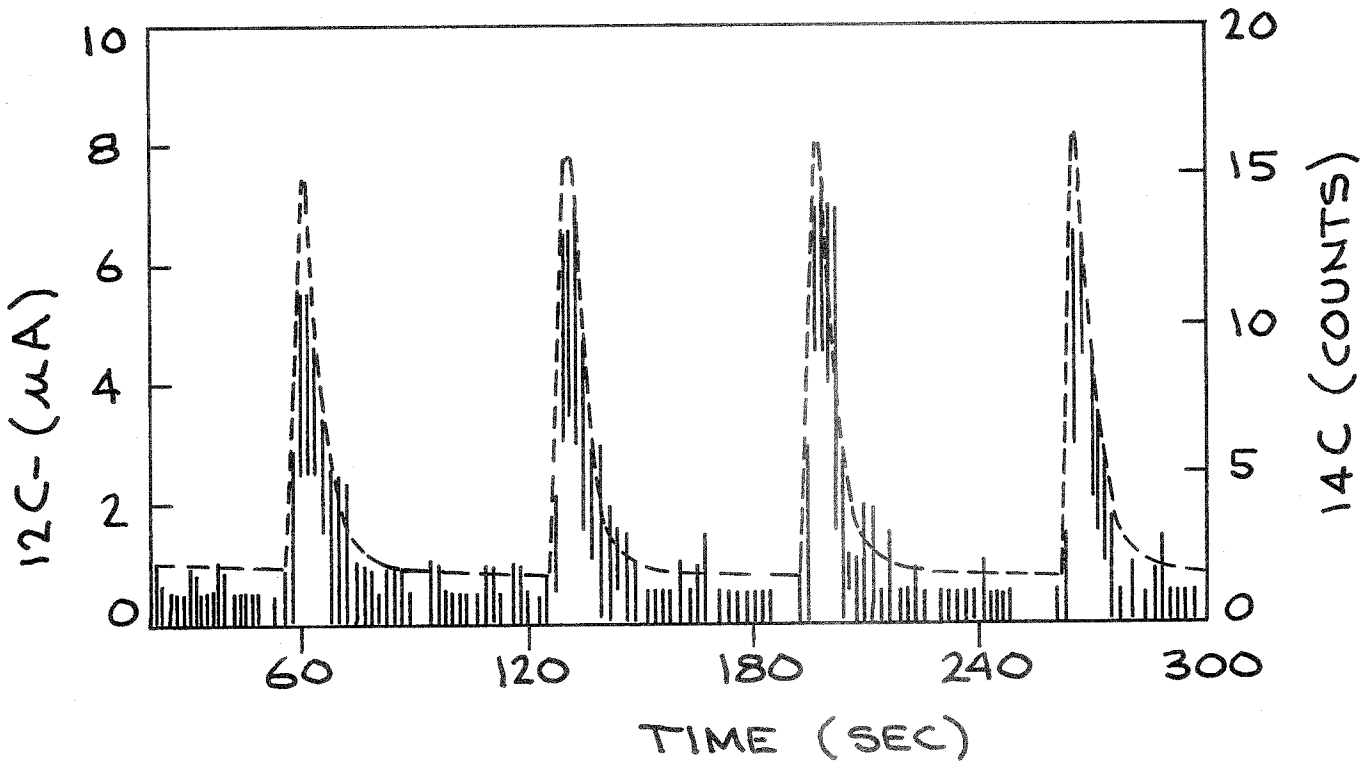
FIG. 7 is FIG. 2 of the Ognibene et al Manuscript showing a plot of the recorded $^{14}C^{+}$ count rate and $^{12}C^{-}$ ion current of four of the 23 peaks recorded over a 30 minute period.

Using our moving wire combustion interface [12], we generated $CO_2$ pulses from 2 ul drops of an aqueous sucrose solution each containing approximately 600 ng carbon. The $CO_2$ pulse was transported in a helium gas stream along a 6 m long×150 um i.d. fused silica capillary to the gas ion source. Total gas flow was estimated to be 0.35 sccm. FIG. 7 (FIG. 2 of Manuscript) shows a plot of the recorded $^{14}C^+$ count rate and $^{12}C^-$ ion current of four of the 23 peaks recorded over a 30-minute period. The peaks all exhibited a rapid rise time of approximately 5 seconds from baseline to peak, followed by a slower return to baseline. Average peak widths were 7.5 seconds, which is on a par with the calculated 8-second sweep time of the gas through the combustion oven of our moving wire interface. We calculated an average ion source efficiency of 1.5%, assuming the efficiency of the interface is 100%. The isotope ratio was determined by manually selecting the limits of the peak based on the $^{12}C^-$ data and subtracting an appropriate background as determined by the data immediately preceding each peak. The average and 1 sigma standard deviation of the isotope ratio was calculated to be 2.91±0.23 counts $^{14}C$/uCoul $^{12}C$. The 8% scatter about the average value is close to the 7% precision expected from pure counting statistics of the roughly 200 $^{14}C$ counts contained in each peak.

Stripper Dependence on Ratio

Our 1-MV AMS spectrometer uses a diffuse argon gas in a recirculating stripper canal to break up interfering molecular isobars. The gas density is monitored with a thermocouple gauge located above the stripper canal and a gas pressure of at least 42 mTorr is required for complete molecular ion destruction. However, ion losses due to scattering increase as gas density increases. This ion source measures the stable isotope prior to entering the accelerator so any drift in the stripper pressure will result in a change in the measured isotope ratio. We wanted to investigate the magnitude of this effect.

Figure 8A:
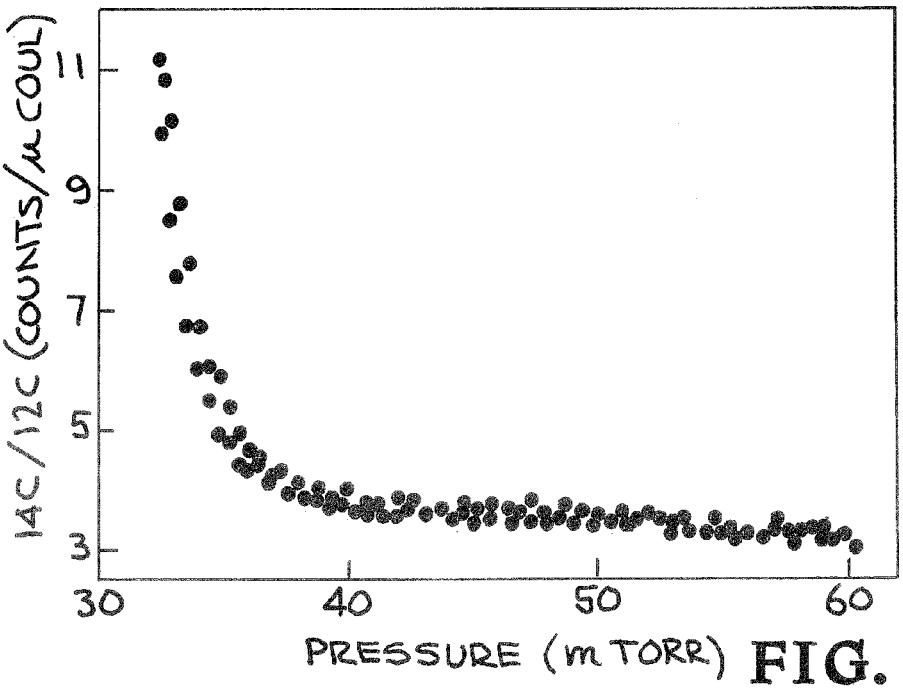
FIG. 8A is FIG. 3 of the Ognibene et al Manuscript showing the results of 10-second measurements of a graphitic sample of ANU sucrose while varying the stripper pressure
Figure 8B:
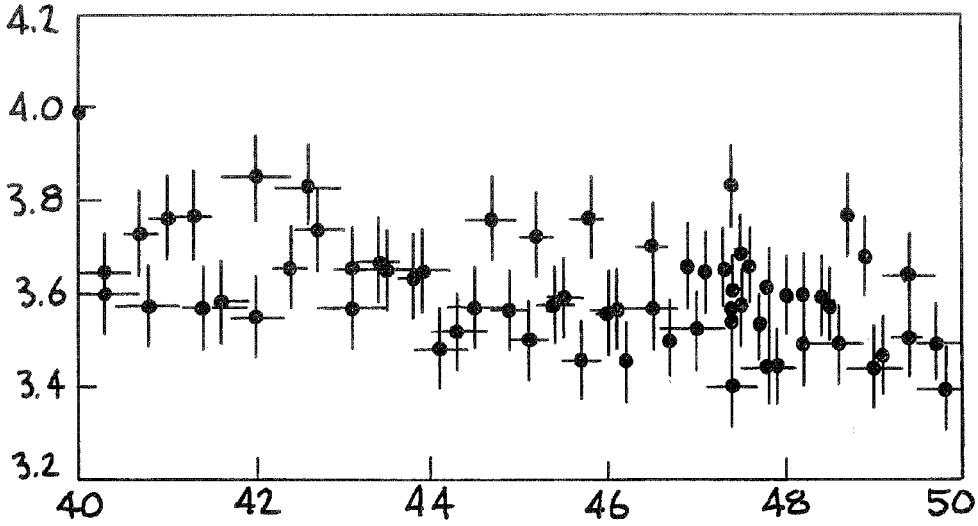
FIG. 8B shows a section of the graph of FIG. 8A in greater detail.

FIGS. 8A and 8B (FIG. 3 of Manuscript) shows the results of 10-second measurements of a graphitic sample of ANU sucrose while varying the stripper pressure. At stripper pressures below 40 mTorr, incomplete molecular isobar destruction is evident while the isotope ratio slowly decreases at stripper pressures above 40 mTorr, which is a direct result of $^{14}C$ ion losses due to scattering. The inset plot shows the data around our normal operating pressure range from 42 to 48 mTorr. In this region, the isotope ratio varies by 3%, which is approximately equal to the variation expected from the counting statistics derived from the ~1000 $^{14}C$ counts in each data point.

This indicates that for biomedical AMS measurements, the effect of stripper pressure on the measured ratio can be ignored as long as the stripper pressure is not allowed to drift outside of the 42-48 mTorr normal operating pressure.

Transmission

The optimal transmission through the stripper canal depends on the careful matching of the accelerator entrance lens with the injected ions' energy and mass. Again, since our system measures the $^{12}C^-$ ions after the first injector magnet and we do not bounce the ions through the accelerator, we wanted to select the optimal tandem accelerating voltage to maximize the $^{14}C$ transmission. Maximizing the $^{14}C$ transmission has a direct impact on the precision that can be obtained from a transient $CO_2$ peak injected into the ion source from a continuous flow interface.

We measured the $^{14}C/^{12}C$ ratio for a graphitized ANU sucrose sample while varying the tandem accelerating voltage. Using the $^{14}C$ count rate from an elevated sample, we tuned the high-energy end of the system at each energy and then measured the ANU sucrose sample for 30,000 $^{14}C$ counts. The transmission was calculated by comparing the measured ratio to the expected ratio of the ANU sucrose, which has an accepted $^{14}C/C$ ratio of 1.508 Modern.

Figure 9:
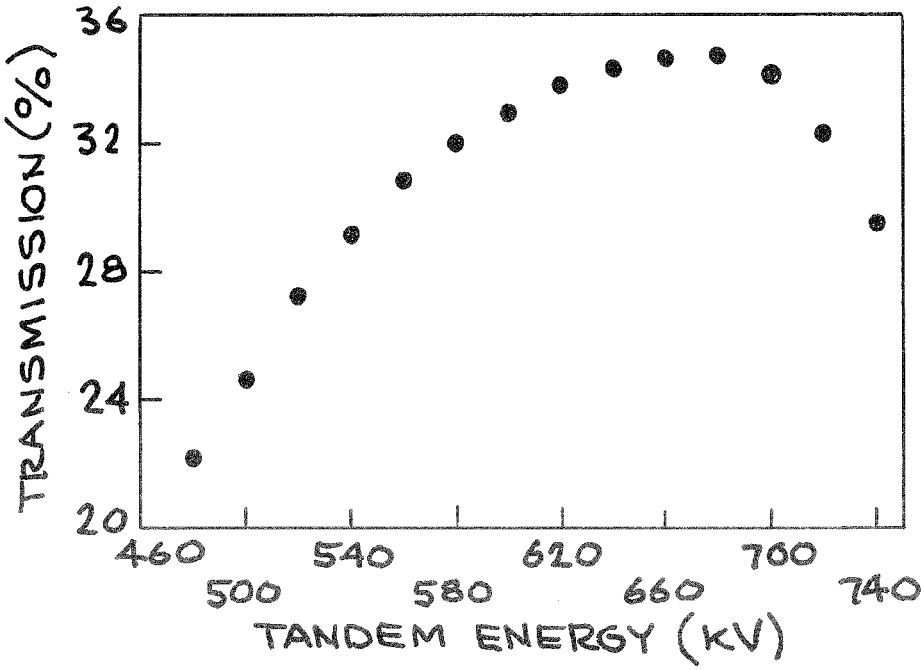
FIG. 9 is FIG. 4 of the Ognibene et al Manuscript showing plotted results.

The results are plotted in FIG. 9 (FIG. 4 of Manuscript). The $^{14}C$ ion transmission reaches a narrow plateau of ~35% at tandem energies between 660 kV and 680 kV. Ion losses can arise from at least three main sources: losses due to scattering, losses due to charge state distribution and, losses due to any mismatch between the ion beam emittance and the acceptance of the beam transport system, which may change with energy. No attempt was made to differentiate between these three sources, although nearly 50% of the ions should be in the +1 charge state at this energy [13].

Instead we focused on empirically determining the optimal tandem accelerating voltage that would give the highest transmission for the $^{14}C$ ions.

Solid Sample Reproducibility and Comparison

As a comparison to results obtained from our standard ion source, we prepared [4] and measured solid graphitic samples of material whose $^{14}C/C$ content ranged from 0.1 Modern to 100 Modern. These levels of $^{14}C$ span the vast majority of concentrations found in bioAMS samples. Each sample was measured 4-7 times with the collection of at least 10,000 $^{14}C$ counts or for 30 seconds, whichever came first, as this is our procedure for typical bioAMS samples. The data were taken over 5 days within a 2-week period. Raw ratios were normalized to similarly prepared and measured samples of ANU sucrose.

TABLE II

| Sample | Hybrid Source Measured FM Average | LLNL Source Measured FM Average |
|---|---|---|
| 0.1 Modern Tributyrin | 0.1004 ± 0.0081 (8.1%) | 0.1195 ± 0.0119 (10%) |
| 0.25 Modern Tributyrin | 0.2331 ± 0.0079 (3.4%) | 0.2728 ± 0.0100 (3.7%) |
| ANU Sucrose (1.5 Modern) | 1.509 ± 0.019 (1.3%) | 1.508 ± 0.0010 (0.7%) |
| 12 Modern Oxalic Acid | 12.20 ± 0.36 (3.0%) | 12.32 ± 0.21 (1.7%) |
| 100 Modern Oxalic Acid | 104.4 ± 2.7 (2.6%) | 102.2 ± 1.7 (1.7%) |

The data are summarized in Table II by showing the averages of all the samples. Also, we compare our results to those obtained using our standard ion source. The data compares favorably except for the nominal 0.1 Modern and 0.25 Modern tributyrin samples. These samples are at the lowest level of our typical bioAMS samples and are not measured to as high a precision as the other sample types. Typical throughput using this ion source was ~95 samples/day, slightly lower than the typical 105 samples/8-hour day throughput obtained with our other ion source Conclusions These results from our newly installed ion source demonstrate its effectiveness in reliably measuring $^{14}C/^{12}C$ isotope ratios from solid graphite targets. However, much work remains to be completed before the source and interface are brought into service for routine analysis of transient $CO_2$ pulses. In particular, the effects of sample-to-sample cross contamination on ion source and interface operation need to be fully understood. Before we can begin tests with $CO_2$ containing elevated levels of $^{14}C$, we must demonstrate that we are preventing the release of $^{14}CO_2$ into the room atmosphere. While these amounts do not present a health hazard, they do represent a potential source of contamination that could negatively impact the ultrasensitive, low background $^{14}C$-AMS measurements that are conducted on our 10 MV FN tandem, which is co-located in the same building. The references cited in this manuscript are identified in Table III.

TABLE III

| References |
|---|
| [1] T. J. Ognibene, G. Bench, T. A. Brown, G. F. Peaslee, J. S. Vogel, International Journal of Mass Spectrometry 218 (2002) 255. |
| [2] T. J. Ognibene, G. Bench, T. A. Brown, J. S. Vogel, Nuclear Instruments & Methods in Physics Research Section B-Beam Interactions with Materials and Atoms 223-224 (2004) 12. |
| [3] J. Southon, M. Roberts, Nuclear Instruments and Methods in Physics Research Section B 172 (2000) 257. |
| [4] T. J. Ognibene, G. Bench, J. S. Vogel, G. F. Peaslee, S. Murov, Analytical Chemistry 75 (2003) 2192, |
| [5] M. L. Chiarappa-Zucca, K. H. Dingley, M. L. Roberts, C. A. Velsko, A. H. Love, Analytical Chemistry 74 (2002) 6285. |
| [6] J. A. Ferry, R. L. Loger, G. A. Norton, J. E. Raatz, Nuclear Instruments and Methods in Physics Research A 382 (1996) 316. |
| [7] T. J. Ognibene, G. Bench, T.A. Brown, J. S. Vogel, Nuclear Instruments & Methods in Physics Research Section B-Beam Interactions with Materials and Atoms 259 (2007) 100. |
| [8] J. Southon, G. dos Santos, B. X. Han, Radiocarbon 49 (2007) 301. |
| [9] J. Southon, G. M. Santos, Nuclear Instruments & Methods in Physics Research Section B-Beam Interactions with Materials and Atoms 259 (2007) 88. |
| [10] J. R. Southon, G. M. Santos, Radiocarbon 46 (2004) 33. |
| [11] G. A. Salazar, T. J. Ognibene, Nuclear Instruments & Methods in Physics Research Section B-Beam Interactions with Materials and Atoms, these proceedings (2011), |
| [12] A. T. Thomas, T. J. Ognibene, P. F. Daley, K. W. Turteltaub, H. Radousky, G. Bench, accepted for publication in Analytical Chemistry (2012). |
| [13] S. A. W. Jacob, M. Suter, H. A. Synal, Nuclear Instruments & Methods in Physics Research Section B-Beam Interactions with Materials and Atoms 172 (2000) 235. |

"Design of a Secondary Ionization Target for Direct Production of a C− Beam from CO2 Pulses for Accelerator Mass Spectrometry" by Gary Abdiel Salazar and Ted Ognibene

[Salazar et al Manuscript]

Abstract

We designed and optimized a novel device that directs a CO2 gas pulse onto a Ti surface where a Cs+ beam generates C− from the CO2. This secondary ionization target enables an accelerator mass spectrometer to ionize pulses of CO2 in the negative mode to measure 14C/12C isotopic ratios in real time. The design of the targets were based on computational flow dynamics, ionization mechanism and empirical optimization. As part of the ionization mechanism, the adsorption of CO2 on the Ti surface was fitted with the Jovanovic-Freundlich isotherm model using empirical and simulation data. The inferred adsorption constants were in good agreement with other works. The amount of injected carbon and the flow speed of the helium carrier gas improved the ionization efficiency and the total amount of 12C-produced until reaching a saturation point. Linear dynamic range between 150-1000 ng of C and optimum carrier gas flow speed of around 0.1 mL/min were shown. It was also shown that the ionization depends on the area of the Ti surface and Cs+ beam cross-section. A range of ionization efficiency of 1-2.5% was obtained by optimizing the described parameters.

1. Introduction

Accelerator Mass Spectrometry (AMS) is a spectroscopic technique that precisely measures the ratio of long-lived radionuclides to the abundant isotope (e.g. 14C/12C). For biological studies, 14C is an excellent molecular label due to its natural low abundance. Sample preparation for AMS routinely follows a time-consuming procedure of oxidizing samples (combustion) labeled with 14C, followed by graphitization of the CO2. Conventional AMS is able to produce an intense beam of negatively charged carbon (C−) from the graphite by using Secondary Ionization sources (e.g. Cs+ beam as the primary ion). AMS can reach the ultra high sensitivity to count 14C atoms by efficiently eliminating the spectroscopic interferences. AMS destroys the molecular structure of the isobaric interferences (e.g. 12CH2−, 13CH−) with high energy collisions in the MeV range. Furthermore, the ion source works in the negative mode as 14N does not form stable negative ions. Elimination of the graphitization step, by the direct ionization of a continuous flow or a pulse of CO2 is very important to reduce sample turnaround time and to minimize the sample size required for the analysis. As Ognibene et al. have pointed out, direct ionization of CO2 is also useful as a method to couple the AMS instrument with separation techniques like HPLC following combustion. The amount of carbon contained in any given eluent peak is small and of order of a few micro-grams. Although possible, graphitization of such small samples is time consuming and difficult. It is necessary that any direct ionization method for CO2 must produce a high current of C− in order to obtain precise isotope ratio measurements. A microwave-plasma has been used to produce C+ from CO2, coming from a Gas Chromatograph; then the C+ is converted into C− by using a charge-exchange canal. Other papers have demonstrated the feasibility of producing C− when CO2 comes in contact with a high energy beam of Cs+ and with the surface of a transition metal (e.g. titanium). Hughey et al. was the first in coupling this type of ion source with a GC. The device used to bring in contact the CO2 with the Cs+ the targets of the works mentioned above, were based on the Heinemeier or Bronk designs. Middleton compared the C− signal from CO2 using a Cs+ beam for different metals. The relative signals compared with Ti were: 0.72, 0.64, 0.54, 0.24, 0.15, 0.06, and 0.02 for Zr, Sc, Ta, Ni, Mg, Cu, and Au respectively. The advantage of Ti over the other metals lies in its high adsorption efficiency to CO2. With this in mind, we designed a new target with a Ti insert that controls the flow of CO2 for better interaction with the Cs+ beam and better adsorption onto the Ti surface. This work focuses on target design, the adsorption theory and empirical parameters (helium carrier gas flow, CO2 amount and Ti target area) that affect the generation of 12C− from CO2.

2. Materials and Methods 2.1 CO2 Pulse Injection System

Figure 10A:
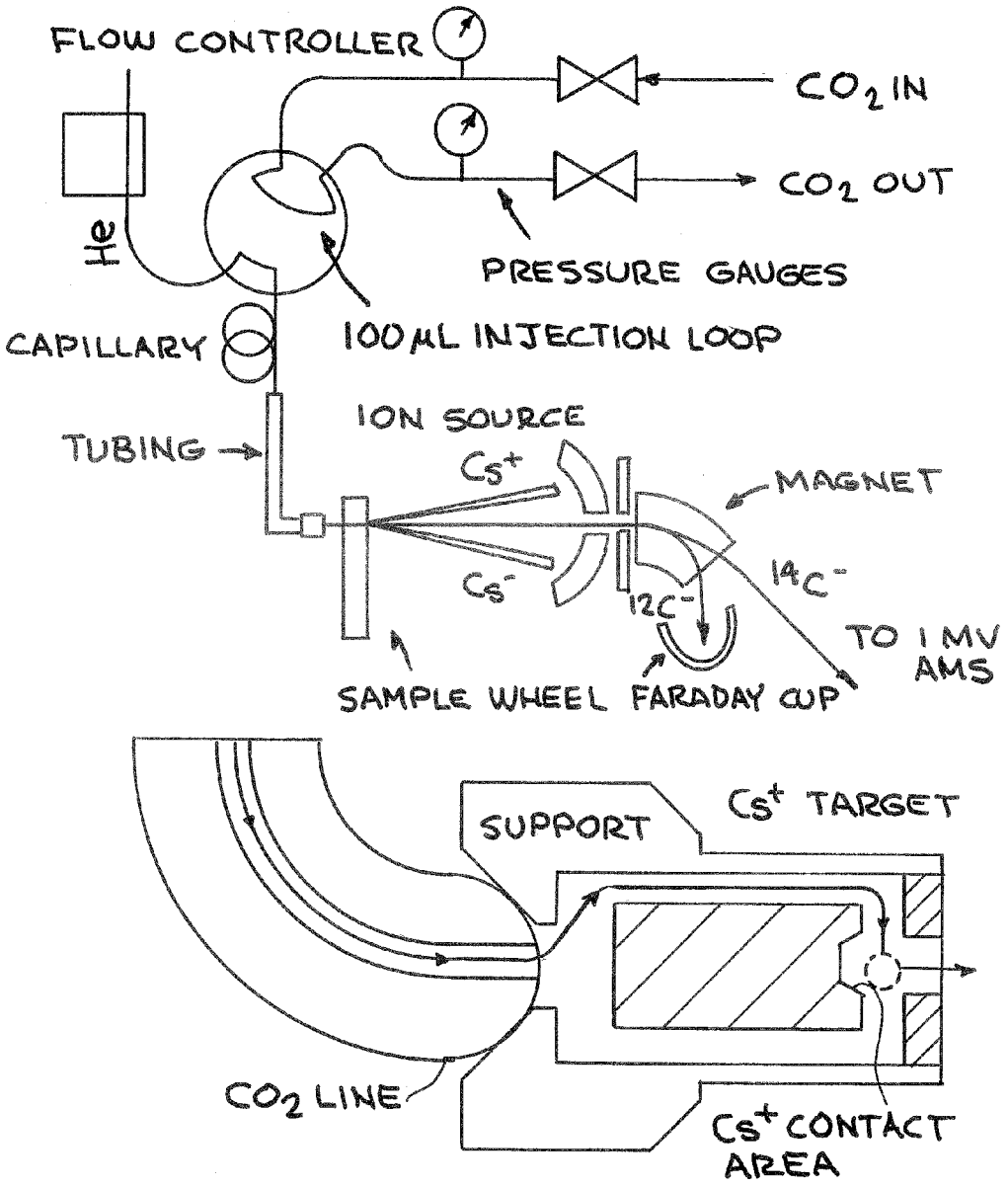

The scheme of the CO2 injection system is shown in FIG. 10A (FIG. 1*a* of Manuscript). A tank containing pressurized CO2 (Instrument grade 99.99% purity, Airgas Co.; Bowling Green, USA) was connected to an electrically actuated GC injection valve with a 100 μL sample loop (Valeo Instruments Co., Waterbury, USA). The pressure inside the sample loop was measured with 2 pressure analog-todigital transducers (MKS, Andover, USA) connected at both ends. The CO2 flow was controlled with two micro control valves. A dedicated computer program continuously read the CO2 pressure and converted it to grams of carbon based on ideal gas calculations. The pressures at both ends of the sample port, during the filling step, were kept within a relative difference of 4%. The software also was able to read and control the flow-meter (Alicat Scientific, Tucson, USA) dedicated for the He carrier gas coming from a pressurized He tank (Ultra high purity, Airgas Co.; Bowling Green, USA). The injection system and the high-vacuum gas feedthrough of the ion source were connected with a fused silica capillary (3 m long, 0.25 mm id, 0.35 mm od). The feedthrough contained a stainless steel tubing of 30 cm long, 0.5 mm id, 1.6 mm od.

2.2 Gas Targets and Inserts

Figure 10B:
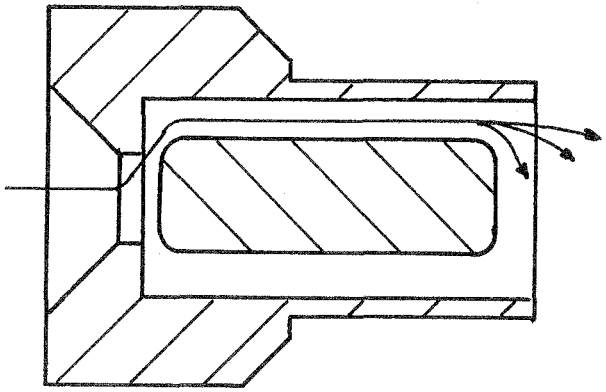
Figure 10C:
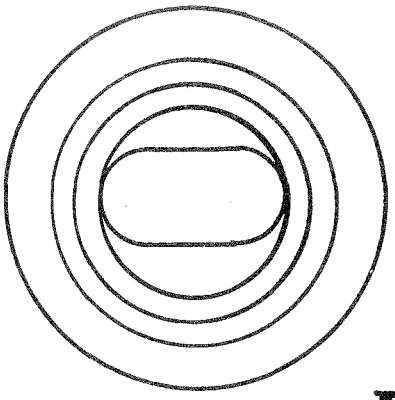
Figure 10D:
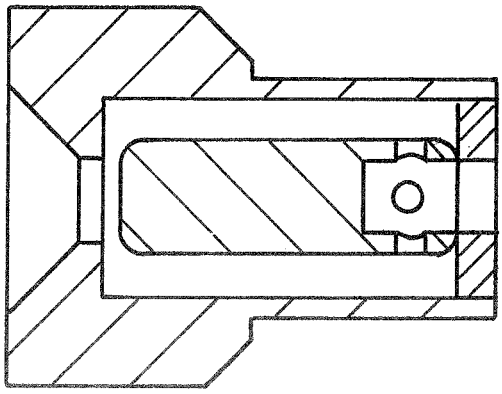
Figure 10E:
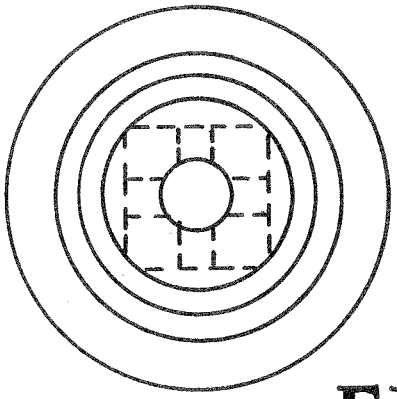

The machined targets consisted on a Ti piece inserted in an aluminum support. The targets were mounted in a standard MCGSNICS sample wheel of a modified NEC ion source. Two configurations of titanium inserts were proposed. FIGS. 10B and 10C (FIGS. 1b and 1c of the Manuscript) illustrate the cavities inside the aluminum supports and the holes drilled in the inserts. The conventional diverging-flow configuration FIGS. 10B & 10D (FIGS. 1b of the Manuscript) was based on a Bronk et al. design. The inserts were made starting from Ti rods of ϕ1.59 mm diameter×4 mm long and compressing them to an oval cross-section of 0.8 mm×1.6 mm. The frontal face of the insert defines the Cs+ contact area. A novel insert with directed-flow configuration FIGS. 10C & 10E (FIGS. 1c of the Manuscript) was machined out from Ti rods of ϕ3.17 mm×4 mm long (99.99%, Alfa Aesar, Ward Hill, USA) by drilling 4 entrance holes for the gas (ϕ0.63 mm) and one hole at the front (ϕ1.32 mm×1.2 mm deep). The face of the frontal hole defines the Cs+ contact area. A Ti insert with the same configuration but with a smaller front area was made by drilling the frontal hole at a diameter of 0.79 mm. All the targets and inserts were cleaned by soaking in 10 mL of isopropanol in a 25 mL plastic bottle for 1 hour with periodic shaking.

2.3 Ion Source Conditions

Computer simulations and description of the gas-capable ion source of our AMS instrument were described previously. However, the experiments in this work were carried out using only: the ion source; the first acceleration region; the first mass-scan magnet and the Faraday cup as indicated in FIG. 10A (FIG. 1a of the Manuscript). The experimental conditions were: Cs metal vaporization temperature 170 □C, Cs thermal surface-ionizer power of 134 Watts, Cs+ beam energy 9 KV, negative ions acceleration voltage 40 KV and magnet field 4149 Gauss. These ion source parameters were determined based on the performance of solid graphite targets.

2.4 COMSOL Flow Simulations Inside the Target

Comsol™ (COMSOL, Inc. Los Angeles, USA) is a finite element analysis, solver and simulation software. Navier-Stokes partial differential equations were used for compressible and laminar flow conditions. The simulation of the target was defined in 2D axisymmetric geometry. The entrance of the target was taken as the flow boundary for a constant laminar inflow of He at 0.5 mL/min which is the flow to be leaked inside the ionization source. The exit of the target was taken as a pressure boundary at $1\times10^{-6}$ Torr which is the background pressure of the ion source when flow is leaked inside. The convection and diffusion simulation of CO2 was added by starting a pulse of CO2 with concentration distributed with a Gaussian function and the CO2 behavior was simulated in a time dependent fashion until 7 s. Comsol™ applies a dynamic method to mesh the geometry to be solved thus the mesh density w but denser at regions of high curvature. In total, it used 2×106 mesh units in an area of 4 cm2. All the physicochemical properties of the involved gases were added from the Comsol material library. Only the solid surfaces in contact with the flow were defined and all were designated as boundary conditions without including adsorption interactions with the walls 3. Results and Discussion 3.1 Flow Simulations Inside the Target The design of the target was mostly done with the help of computer simulations. The simulations helped us to decide between a diverging-flow or a directed-flow configuration FIGS. 11A and 11B (FIGS. 2a and 2b of the Manuscript). In our simulations, the pulse of CO2 was started from the entrance of the target at an initial concentration following a Gaussian function where t is time and c0, b0 and t0 are constants that affect the total amount of CO2, the width and center position of the pulse peak, respectively. These constants were set at values that emulated the empirical results. FIG. 11B (FIG. 2b of the Manuscript) shows that by selecting the values of b0 and t0, 2000 s-2 and 0.08 s, respectively; the simulated pulse emulated the same FWHM as the experimental average. Experimentally, a specific number of moles of CO2 were pulsed and injected into the target; however, in simulation, the CO2 can not be inputted as moles but as a distribution of concentration (Eq. 1). The moles of injected CO2 contained in such simulated pulse can be calculated by integrating the CO2 flux (mole/m2s) over a whole cross section area, located near the exit of the target, and then integrating over the time (T) that the CO2 pulse needs to cross such cross section. The value of c0 that corresponded for a certain experimental CO2 injection was found by trial and error until the double integral equaled the amount of experimentally injected moles of CO2.

[{Equation not ready}] [Equation 1]

Figure 11A:
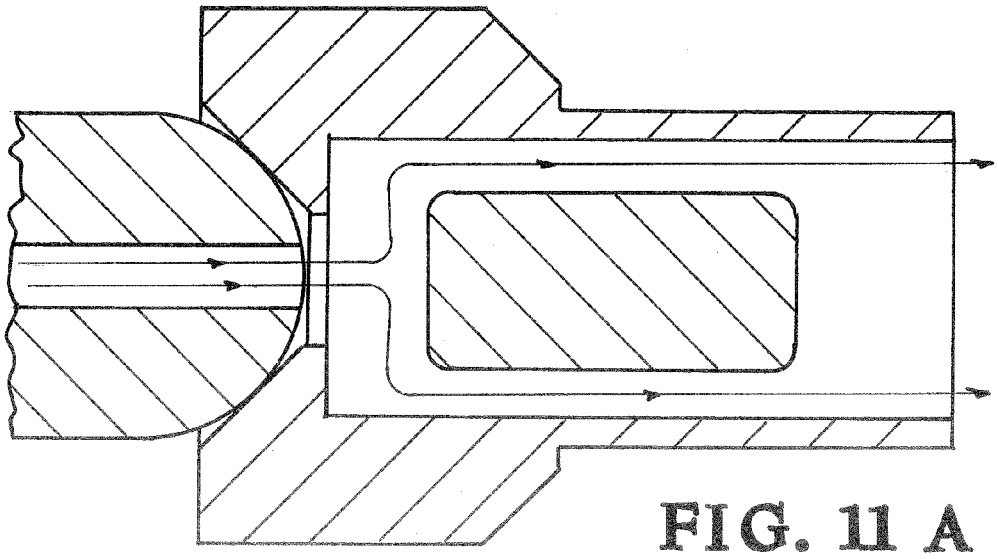
FIGS. 11A and 11B are FIGS. 2*a* and 2*b* of the Salazar Manuscript showing calculated CO2 concentration profiles.
Figure 11B:
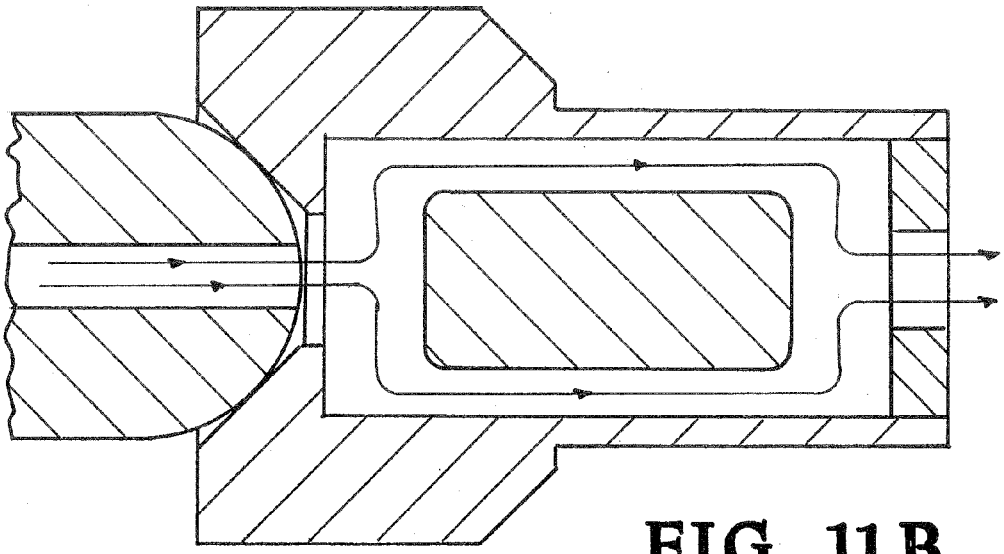

FIGS. 11A and 11B (FIGS. 2a and 2b of the Manuscript) illustrate diverging flow and directed flow respectively and the calculated CO2 concentration profiles along the fluidic cavities inside the targets at the time point when the pulse has just reached the front face of the titanium surface. The concentration profiles are in a rainbow-color code. For the directed-flow configuration, most of the CO2 in the pulse is located in the blue region and for the diverging-flow configuration, the CO2 band is defined by the green region. The concentration profiles along the red lines on are graphed. Comparing the minimum values of both graphs, it can be seen that at the Ti surface for the directed flow, the gas concentration profile is 1.7 times higher than for the diverging-flow configuration. The velocity arrows of the diverging flow configuration show that during the gas expansion, only a fraction of the gas molecules will travel towards the surface. In the other hand, by directing the flow through ducts towards the surface, more molecules get adsorbed on the surface at the location where the Cs+ beam impacts the Ti surface (front face), which should lead to increased CO2 ionization efficiency. The simulations (data not shown) also indicated that the peak of the CO2 concentration broadens when the size of the cavities inside the target increases. For that reason, the sizes of the cavities were selected as small as the machine shop could make them.

3.2 Representative Results of the $_{12}C_-$ Beam

Figure 12A:
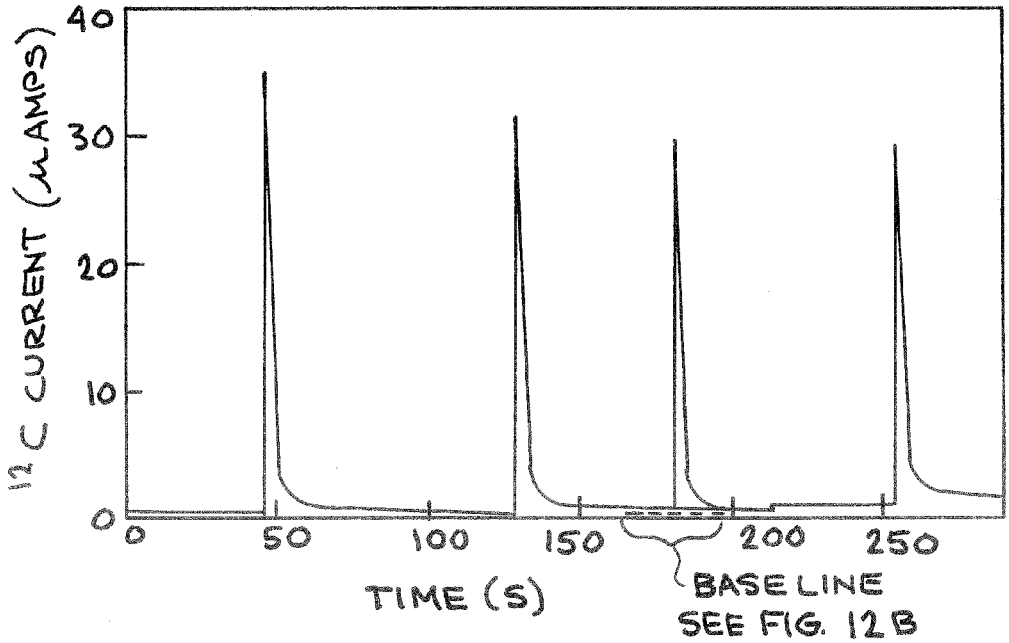
FIGS. 12A and 12B are FIGS. 3*a* and 3*b* of the Salazar et al. Manuscript showing a representative example of the beam current of $_{12}C_-$ ionized from $CO_2$ pulses.
Figure 12B:
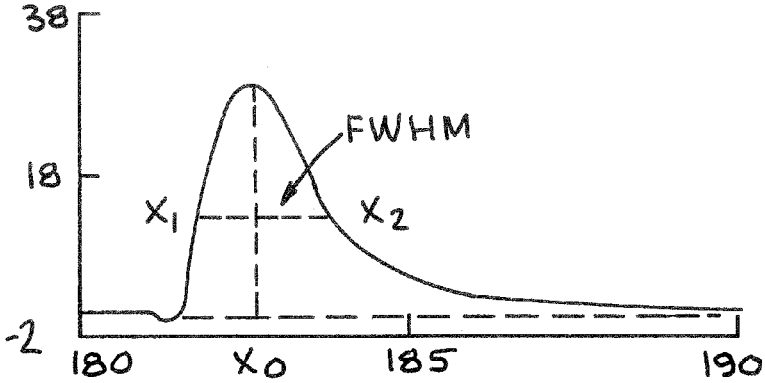
Figure 13A:
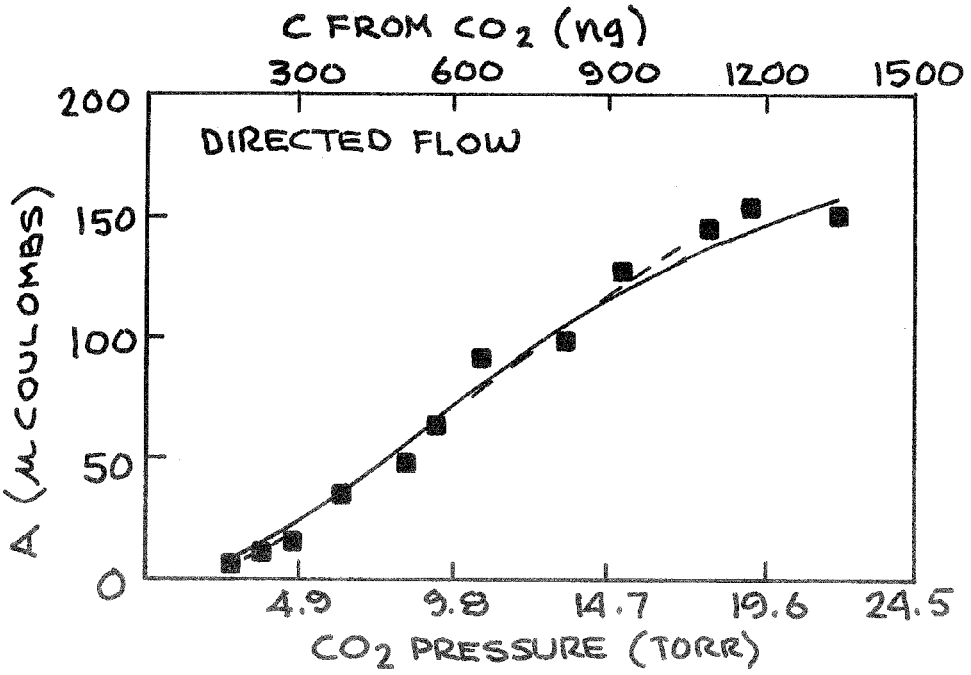
FIGS. 13A, 13B, 13C, and 13D are Figures from FIG. 4 of the Salazar et al. Manuscript) showing the ionization efficiency.
Figure 13B:
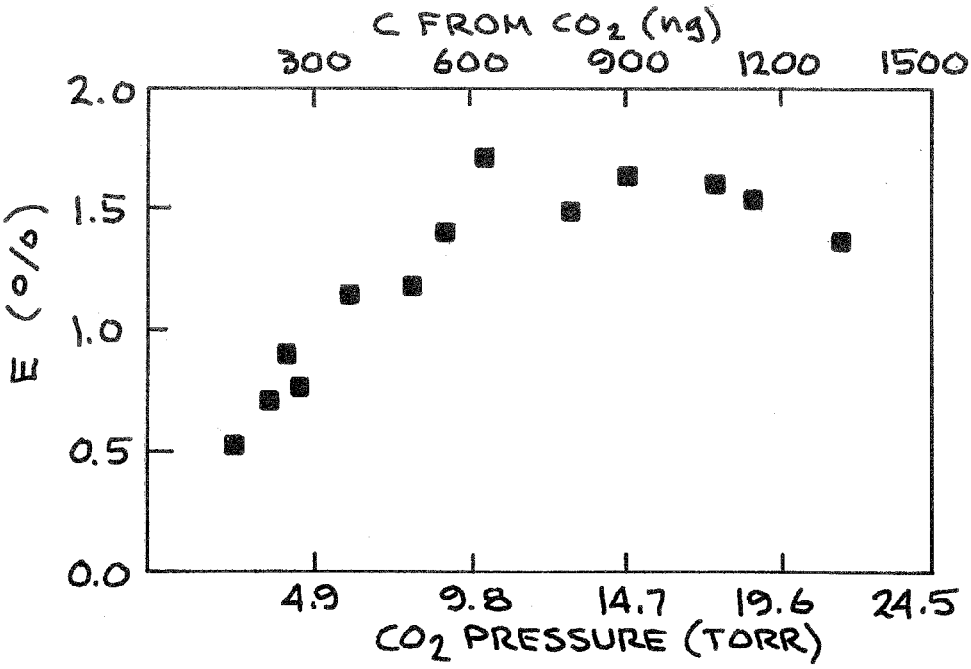
Figure 13C:
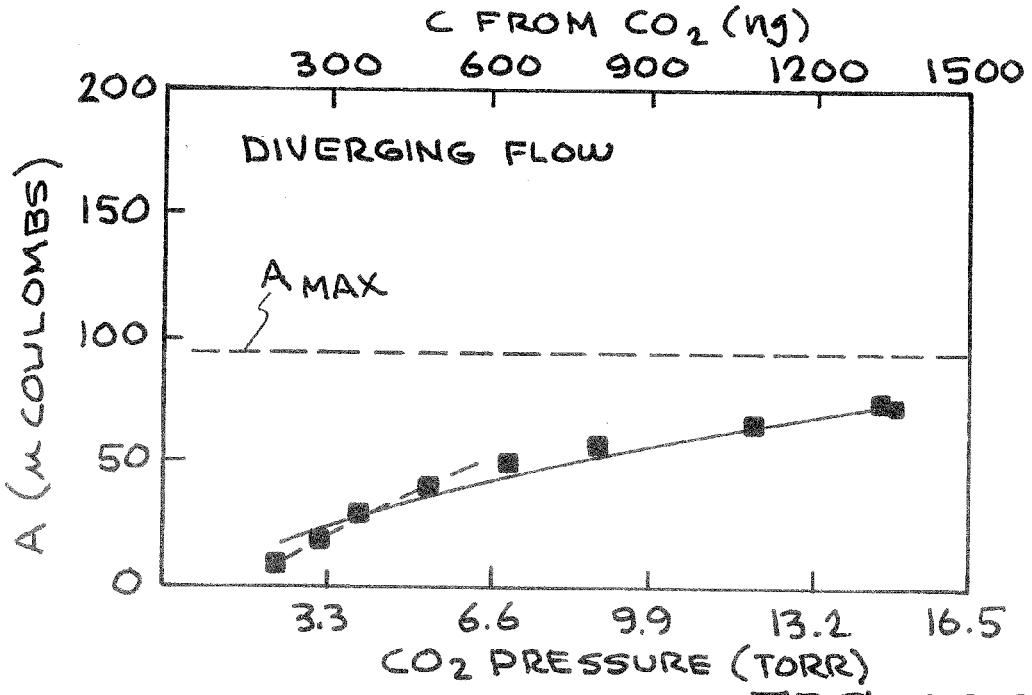
Figure 13D:
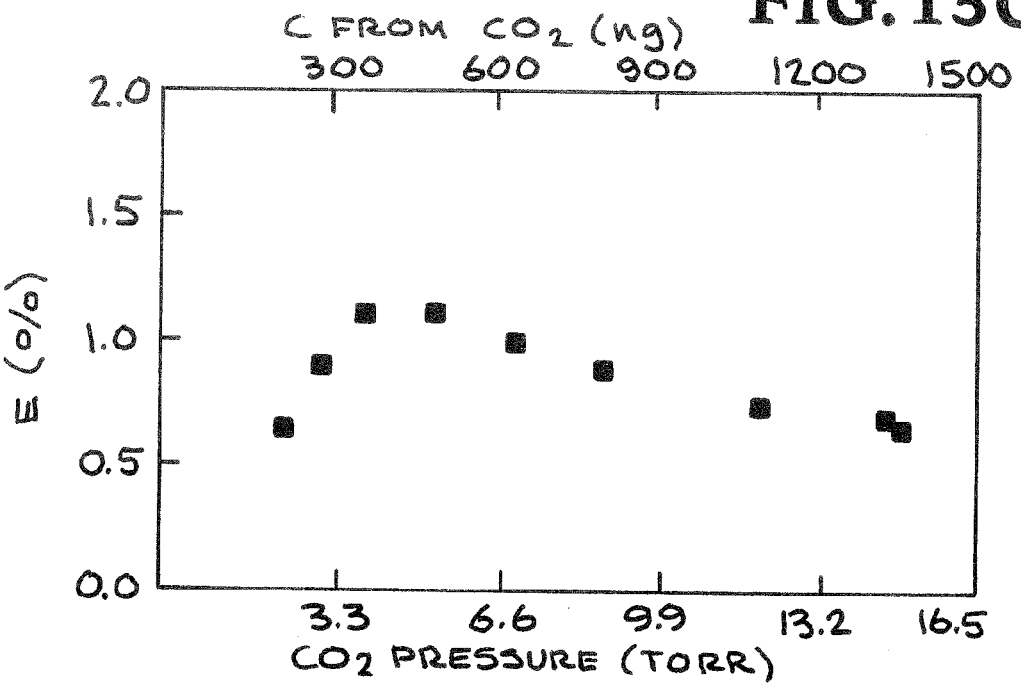

A representative example of the beam current of $_{12}C_-$ ionized from $CO_2$ pulses is presented in FIGS. 12A and 12B (FIGS. 3*a* and 3*b*) of the Manuscript). The $_{12}C_-$ total charge corresponding to each $CO_2$ pulse was measured by numerical integration of the peak and subtracting the area under the baseline. The start and end points of the peak were visually selected. The $_{12}C$-current detected by AMS for the analysis of carbon graphite is normally on the order of 100 μA while the peak height of the $CO_2$ pulses is 40 μA. High precision isotope ratios can only be obtained when the initial beam current is high. This is a disadvantage of our direct ionization of $CO_2$ compared with the graphite analysis. FIGS. 12A and 12B (FIGS. 3*a* and 3*b*) also illustrates memory effects. The three first peaks were obtained with a new Ti insert and the fourth peak was obtained with a Ti insert extensively used over 3 days. FIGS. 12A and 12B (FIGS. 3*a* and 3*b*) shows that the background level for the old insert is higher. We think that this memory has negligible effect on the area calculation because the background is practically flat. In the other hand, the height of the last peak is slightly lower due to degradation of the Ti insert with the constant sputtering, elevating the RSD of the areas to 9.4%. In our experience, there is not change in the signal during the first 60 min of continuous use of a new target. Therefore, for future applications, one target will be able to withstand one HPLC run. FIG. 12B (FIG. 3b of the Manuscript) shows that the peaks had a typical short rise time from the base line to the peak (<0.8 s), indicating that the $CO_2$ pulse band was kept narrow due to the small inner diameter of the capillary used to transport the pulse from the injection system to the ion source. The peak tailing magnitude ($x_2-x_0$) depended on the amount of injected $CO_2$ and gas carrier flow. The typical value of the asymmetry factor ($[x_2-x_0]/[x_0-x_1]$) was ~1.8 or ~3.5, measured at 50% or 10% of peak height respectively. The peak tailing was the result of the adsorbed $CO_2$ and the residual gaseous $CO_2$ that is not immediately pumped away. The $_{12}C_-$ total charge per pulse, the peak shape and the ionization efficiency were the parameters that we chose to study the performance of the system. Ionization efficiency was defined as the total moles of detected charge (magnet set at m/z=12) relative to the moles of $$E = \frac{C^-}{C} = \frac{A \times K}{C} \quad \text{[Equation 2]}$$

carbon from the injected $CO_2$. See definition in Eq. 2, where A (micro coulombs) is the total charge integrated from the current signal (micro-Amps). K is the inverse of the Faraday constant. C (micro moles)=PV/RT where P, T are the average pressure and temperature of $CO_2$ in the sample loop registered by both gauges; V is the volume of the sample loop, and R is the gas constant. In short, the simulations offered a first insight in the differences between the conventional diverging-flow and the new directed-flow configurations. Also, the simulated behavior of the CO2 pulses inside the target was reproduced experimentally.

3.3 Adsorption Theory of CO2 on Ti

Our hypothesized mechanism for the CO2 ionization can be described as follow: first CO2 is brought in contact with a Ti surface and is adsorbed; then the high-energy Cs+ particles hit the adsorbed CO2, triggering its fragmentation into C and O elements. The negative charge in the C atoms might be due to electron capture at the Ti surface level. It is known that fragmentation of triatomic molecules can be induced with collisions with energetic particles. The charging of the carbon atoms must occur at surface level because the velocity of the electrons in the gasphase, in a kilovolt potential difference, is too high for being captured by neutral atoms. The adsorption step can be studied using the Jovanovic-Freundlich isotherm models. These two models have been extensively studied individually or in combination in several papers, and the combination is shown in eq. 3, The Freundlich model which is an empiric model for gaseous adsorbates has the form $\theta=(\beta P)v$, where $\beta$ is a proportional constant.

$$\theta = \frac{q_{ads}}{q_{max}} = 1 - e^{-(\alpha P)^{\nu}} \quad \text{[Equation 3]}$$

In Eq. 3: $\alpha$ is a factor that depends on the $CO_2$ adsorption rate over the vapor pressure (Eq. 4.), $q_{ads}$ is the specific amount of adsorbed molecules, $q_{max}$ has the same units as $q_{ads}$ and it is the saturation or monolayer capacity of the adsorbent, $\theta$ is the fractional coverage or fraction of occupied sites relative to the total availability, P is the partial pressure of the molecule of interest in the bulk near the Ti surface and v is the homogeneity parameter. The amount of adsorbed $CO_2$ ($q_{ads}$) is proportional to the measured total charge of $_{12}C_-$ (A), therefore the fractional coverage can be expressed as: $q_{ads}/q_{max}=A/A_{max}$. P is proportional to the amount of injected $CO_2$ (C); however it can not be experimentally determined. P can be indirectly measured from the simulation by applying the ideal gas law to the $CO_2$ transient concentratio. Finally, P is obtained by averaging the transient pressure. As explained earlier, the simulation conditions and constants values were selected by trial and error until matching the amount of injected $CO_2$ and the experimental peak shape. The Jovanovic model states that every gas particle that reaches the surface is adsorbed only during an average time of residence (r). r can be increased due to collisions with gaseous particles thus the desorbing particle bounces back to the surface.

$$\alpha = \frac{\sigma\tau}{\sqrt{2\pi mkT}} = \frac{e^{(\varepsilon_{ad}-\Delta H_{vap})/RT}}{P_S} \quad \text{[Equation 4]}$$

In eq. 4: $\sigma$ is the adsorbate collision cross section (17 $Å_2$ for $CO_2$), r is the average residence time; $E_{ad}$ is the adsorption potential energy, $\Delta H_{vap}$ and $P_s$ are the heat of vaporization (4.93 KJ/mol) and the vapor pressure ($4.92\times10_4$ Torr at 298 K), respectively. mkT are the $CO_2$ molecule mass, Boltzmann constant and temperature, respectively. These concepts are important for fitting our system because the adsorption process will be controlled by the short transient pressure of the $CO_2$ pulse in contact with the Ti surface. Examples of the fitting of the Jovanovic-Freundlich model for both configurations. The parameter $\alpha$ will be extracted from the fittings of Eq. 3; $E_{ad}$ and r from Eq. 4. The agreement of the model demonstrates that adsorption must be part of the mechanism of conversion of $CO_2$ into C−. The fitted parameters of the model are presented in table I. As in any other adsorption system, the data saturate at a point $A_{max}$. $A_{max}$ is proportional to the total capacity or the total number of available adsorption sites. At a carrier flow of 0.15 mL/min, $A_{max}$ for the directed-flow configuration #1 is 1.8 times bigger than for the diverging-flow configuration even though the area of the Ti surface is the same for both configurations. The reason is that some of the adsorption sites of the diverging-flow configuration are poorly exposed to the $CO_2$ due to the gas-flow configuration; thus the effective number of adsorption sites is lower. The $A_{max}$ for the directed-flow configuration #1 is 2.2 times larger than for the same configuration with smaller area (#2). In these two configurations, the gas-flow is the same but the areas are simply different, therein the difference in number of adsorption sites. The parameter v measures the homogeneity of the surface. All the Ti surfaces had the same degree of homogeneity (flat and smooth); however the $CO_2$ gas is differently distributed on the Ti surface for the directed-flow and diverging-flow configurations. Therefore, this difference in distribution translates into different values for the surface homogeneity parameter. Logically, v presents almost the same value for the directed-flow configurations. Eq. 4 states that $\alpha$, $E_{ad}$ and r are independent of the geometry and only depends on the thermodynamics of the surface-adsorbate interaction, and the experimental results agree with this. Our r values agree with Jovanovic who estimated that r should be $10_{-6}$ to $10_{-10}$ s in the case of physical adsorption. Vesselli et al. using Density Functional Theory (DFT), investigated the adsorption energy ($E_{ad}$) of $CO_2$ on several metals. Some examples of these values in eV are: 0.09, 0.11 and 0.32 for Cu, Pt and Ni, respectively. Cu seems to have low affinity for CO2 while Ni has high affinity. In this work, we determined an Ead of 0.26 eV for Ti which means high affinity but lower than Ni. As stated in the introduction, it was expected that Ti will have higher affinity than Ni; however the experimental conditions of the works referenced here are very different. This work was based on experimental and simulation to calculate the adsorption energies. The work from Vesselli et al. was purely DFT calculations and the work from Middleton measured the relative intensities empirically and they did not measured the adsorption energies. In short, the adsorption theory explained the experimental differences between the target-flow configurations. The inferred parameter values were in agreement with independent works. This suggests that adsorption is an important step in the ionization process.

3.4 Optimization of the Ionization

FIGS. 13A, 13B, 13C and 13D (FIG. 4 in the manuscript) shows the ionization efficiency (E) and total integrated charge per pulse (A) for both target configurations versus carbon mass (C). The precision of the amount of injected carbon is taken as the relative difference between the pressure readings of the gauges connected to the sample loop. The injection precision is not graphed in FIGS. 13A, 13B, 13C and 13D (FIG. 4 in the manuscript) as carbon-mass error bars; however, while carrying out the experiments, it was kept lower than 4%. The carbon-mass range starts at 150 ng as the precision of the CO2 injection is higher than 4% at lower masses. By means of Eq. 2, the data A vs C of FIGS. 13A, 13B, 13C and 13D (FIG. 4 in the manuscript) are converted into ionization efficiency (FIGS. 4*c* and 4*d*). The data suggest that CO2 adsorbs on the Ti efficiently (constant efficiency) when it reaches a pressure threshold (maxima of E vs P graph). This threshold seems to be 9.8 Torr and 5.0 Torr for the directed-flow and diverging-flow configurations respectively. Before the threshold, E increases with the increase of A. After the threshold, the CO2 starts to saturate the surface causing the efficiency to start dropping. The linearity of the signal vs amount of carbon (FIGS. 13A, 13B, 13C and 13D (FIG. 4 in the manuscript) is useful for analysis and quantitation of CO2. We propose that this linearity could be useful to quantify organic molecules by detecting the CO2 produced from its combustion and at the same time to measure the rare carbon isotope ratio using an AMS. As proof of principle, the linear dynamic range (LDR) is marked with dashed green lines. The LDR was chosen for the set of points that gave a correlation coefficient (r2) between 0.97-0.98 and starting from the minimum carbon mass. The LDR range (150-1000 ng) and sensitivity (slope and slope confidence) of the directed-flow configuration is better than for the other configurations. As explained above, the reason is that the signal of the other configurations is inhibited by the aerodynamics and the smaller area of the Ti surface, thus their curves saturates faster. The efficiency maximizes near 2.5% at around helium flow of 0.07 to 0.1 mL/min. At high flow, the contact time of CO2 with the Ti surface is shorter and as overall effect, ionization becomes inefficient. Also, at higher flows, the background pressure in the source increases; affecting the mean free path of 12C− ions. In the range of 0.05-0.35 mL/min, the pressure linearly increased 1 order of magnitude until reaching 5.0×10-6 torr. This is the range where the ionization efficiency decreases. At He flow values below 0.05 mL/min, the pressure was almost constant (6.0×10-7 torr). At these low flow rates of the carrier gas, CO2 experiences diffusion considerably and the peak shape broadens. For compatibility purposes with HPLC and GC, the capacity to detect short pulses is important in order to maintain the resolution of the chromatographic technique. The peak shape optimizes at 0.1 mL/min because the peak height is maximum and the FWHM is cut at the half. If this ion source is coupled to a CO2 pulse-producing analytical system, the carrier flow speed is likely to be determined by the analytical system. This ion source could be used at any flow rate between 0.02 to 3 mL/min and the FWHM will be in the range of 4-10 s. The behavior of the tail vs flow is the same as for the FWHM and the tail ranges between 2.6 and 6.4 s (data not shown). The peak tail was measured as (x2−x0) and FWHM=x2 x1. For our data set, it can be demonstrated that (x2−x0)=0.64 FWHM because the asymmetric factor ([x2−x0][x0−x1]=1.8) is relatively constant. In order to take full advantage of the adsorption process, it is best to ensure that the whole Ti surface is sampled by the Cs+ beam. The position of the target was moved step by step at positions downstream of the Cs+ beam waist. Beyond the beam waist, the Cs+ beam cross-section is bigger. The efficiency was improved because a Cs+ beam with higher cross-section can sample more adsorbed CO2. Throughout the results of this work, the ionization efficiency or yield has ranged from 1 to 2.5% for carbon mass higher than 400 ng when using the directed-flow configuration with high Ti area. For masses lower than 400 ng, the same configuration with lower area presented 1% efficiency. It can be found, in the literature, efficiencies of 8% for continuous flow at low speed, containing tens of μg of carbon; and 1.5-6% for the μg range of carbon. Kjeldsen reported efficiencies between 0.5-1.5% for long pulses or continuous-flow. In the case of short pulses, Kjeldsen showed lower efficiencies in the range of 0.2-0.8%. For a microwave-plasma ionization of CO2 with charge inversion, the reported overall efficiency was 0.4%. It is expected that the ionization of a continuous flow of CO2 at low speed will be more efficient than the ionization of a fast CO2 pulse. As mentioned before, a low gas flow maintains a better vacuum and mean-free-path for the ion beam transmittance. Also, at low gas flows, the CO2 has higher interaction time with the Ti surface and the Cs+ beam. Our target performance felt in the low range of efficiencies reported for continuous flow systems.

4. Conclusions

A "target" for direct ionization of CO2 in the form of 12C− was designed by computer simulations, adsorption theory and empirical research. It was found that the ionization is optimized with a novel flow geometry that directs the CO2 flow on a Ti surface where a Cs+ beam is bombarding; rather than a diverging-flow configuration. The fitting of the Jovanovic-Freundlich model provided values of adsorption energy and average residence time for CO2 on Ti of 0.26 eV and 40 ns respectively. The agreement of the fitting with the data; and the agreement of the measured constants with other works suggest that adsorption plays a major role in the ionization mechanism. By optimizing the parameters that affect the CO2 interaction with the Ti surface and Cs+ beam (amount of CO2, gas flow, Ti contact area and beam cross-section) effective ionization was obtained in the range of 1-2.5%. The linear dynamic range for the 12C− was from 150 ng to 1000 ng of carbon for the novel directed-flow configuration indicating the potential use of the ionization method to quantify analyte mass and to measure isotope ratios. These results demonstrate the feasibility of using this ionization system for coupling HPLC with an online combustion interface with our AMS instrument for the measurement of 14C/12C molecular isotopic ratios.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An interface apparatus for the analysis of liquid sample having carbon content by an accelerator mass spectrometer comprising:

a wire, spaced paint droplets on the wire, a droplet maker for producing droplets of the liquid sample and placing said droplets of the liquid sample on said spaced paint droplets on said wire, a system that converts the carbon content of said droplets of the liquid sample to carbon dioxide gas in a helium stream, a gas-accepting ion source connected to the accelerator mass spectrometer that receives said carbon dioxide gas of the sample in a helium stream and introduces said carbon dioxide gas of the sample into the accelerator mass spectrometer for analysis, and a system for moving said wire from said droplet maker to said system that converts the carbon content of said droplets of the liquid sample to carbon dioxide gas in a helium stream.

2. An interface apparatus for the analysis of liquid sample having carbon content by an accelerator mass spectrometer comprising:

a wire, spaced solder droplets on the wire, a droplet maker for producing droplets of the liquid sample and placing said droplets of the liquid sample on said spaced solder droplets on said wire, a system that converts the carbon content of said droplets of the liquid sample to carbon dioxide gas in a helium stream, a gas-accepting ion source connected to the accelerator mass spectrometer that receives said carbon dioxide gas of the sample in a helium stream and introduces said carbon dioxide gas of the sample into the accelerator mass spectrometer for analysis, and a system for moving said wire from said droplet maker to said system that converts the carbon content of said droplets of the liquid sample to carbon dioxide gas in a helium stream.

* * * * *